US011732994B1

(12) United States Patent
Pasha et al.

(10) Patent No.: US 11,732,994 B1
(45) Date of Patent: Aug. 22, 2023

(54) LASER TAG MOBILE STATION APPARATUS SYSTEM, METHOD AND COMPUTER PROGRAM PRODUCT

(71) Applicants: Ibrahim Pasha, Arlington, VA (US); Richard Rice, Alexandria, VA (US); James Guan, Derwood, MD (US)

(72) Inventors: Ibrahim Pasha, Arlington, VA (US); Richard Rice, Alexandria, VA (US); James Guan, Derwood, MD (US)

( * ) Notice: Subject to any disclaimer, the term of this patent is extended or adjusted under 35 U.S.C. 154(b) by 306 days.

(21) Appl. No.: 17/035,578

(22) Filed: Sep. 28, 2020

Related U.S. Application Data

(60) Provisional application No. 62/964,106, filed on Jan. 21, 2020.

(51) Int. Cl.
*F41A 33/02* (2006.01)

(52) U.S. Cl.
CPC ..... *F41A 33/02* (2013.01)

(58) Field of Classification Search
CPC ..... F41A 33/00; F41A 33/02; F41A 33/04; F41A 33/06; F41G 3/26; G06Q 30/06; G06Q 30/0625; G06Q 30/0633; G06Q 30/0635; G06Q 30/0641; H04W 12/08; H04W 12/63; H04L 9/08; H04L 9/30; A63F 13/00; A63F 9/24; G06F 17/00; G06F 19/00
See application file for complete search history.

(56) References Cited

U.S. PATENT DOCUMENTS

| | | | |
|---|---|---|---|
| 2,990,471 | A | 6/1961 | Tiffany |
| 5,044,107 | A | 9/1991 | Holford |
| 5,885,129 | A | 3/1999 | Norris |
| 6,261,180 | B1 | 7/2001 | Lebensfeld et al. |
| 6,752,238 | B2 | 6/2004 | Small et al. |
| 7,076,767 | B1 | 7/2006 | Williams |
| 7,291,014 | B2 | 11/2007 | Chung et al. |
| 7,338,375 | B1 | 3/2008 | Small |
| 7,500,917 | B2 | 3/2009 | Barney et al. |
| 7,632,187 | B1 | 12/2009 | Farley et al. |

(Continued)

FOREIGN PATENT DOCUMENTS

| | | |
|---|---|---|
| WO | W2014185861 | 11/2014 |
| WO | WO2016019276 | 2/2016 |

*Primary Examiner* — Timothy A Musselman
(74) *Attorney, Agent, or Firm* — Reston Law Group, LLP; Ralph P. Albrecht

(57) ABSTRACT

A system, method, and computer program product for managing a game can include: receiving, by at least one electronic computer processor, a request to establish a game; establishing the game, including: authenticating a plurality of authorized users; unlocking a plurality of unit devices to provide each of the unit devices to each of the plurality of authorized users from at least one station; and/or managing the game between the plurality of unit devices. The system can include a service provider system. The system can include a station, which can include one or more skates, configured to receive and/or removably lock and unlock a unit device via an exemplary lock and latch mechanism. The station can wirelessly communicate with the unit devices and can be in communication with the service provider system for authentication and/or electronic payment system transactions. The unit device in one embodiment is a laser tag unit device.

20 Claims, 11 Drawing Sheets

(56) References Cited

U.S. PATENT DOCUMENTS

| | | | | |
|---|---|---|---|---|
| 7,846,028 | B2 | 12/2010 | Small et al. | |
| 7,872,849 | B2 | 1/2011 | Elliott, Jr. | |
| 7,896,742 | B2 | 3/2011 | Weston et al. | |
| 7,916,666 | B2 | 3/2011 | Yoon et al. | |
| 8,462,691 | B2 | 6/2013 | Tateson | |
| 8,469,824 | B1 | 6/2013 | Farley et al. | |
| 8,721,460 | B2 | 5/2014 | Rosenblum | |
| 8,837,528 | B2 | 9/2014 | Harris et al. | |
| 8,951,128 | B1 | 2/2015 | Farley et al. | |
| 9,537,986 | B2 | 1/2017 | Halvarsson | |
| 9,692,756 | B2 | 6/2017 | Poisner et al. | |
| 10,338,679 | B2 | 7/2019 | Weston | |
| 2002/0058459 | A1 | 5/2002 | Holt | |
| 2003/0069077 | A1 | 4/2003 | Korienek | |
| 2005/0240496 | A1* | 10/2005 | Davis | G06Q 30/0609 705/28 |
| 2005/0255842 | A1 | 11/2005 | Dumas et al. | |
| 2006/0046606 | A1 | 3/2006 | Martin et al. | |
| 2006/0193283 | A1 | 8/2006 | Harris et al. | |
| 2007/0066395 | A1 | 3/2007 | Harris et al. | |
| 2007/0190494 | A1* | 8/2007 | Rosenberg | A63F 13/803 463/40 |
| 2008/0009345 | A1 | 1/2008 | Bailey et al. | |
| 2008/0039204 | A1 | 2/2008 | Ackley et al. | |
| 2008/0238937 | A1 | 10/2008 | Muraki | |
| 2008/0247408 | A1 | 10/2008 | Yoon et al. | |
| 2009/0083847 | A1 | 3/2009 | Fadell et al. | |
| 2009/0191968 | A1 | 7/2009 | Johnson et al. | |
| 2010/0128653 | A1 | 5/2010 | Tateson | |
| 2012/0178529 | A1 | 7/2012 | Collard et al. | |
| 2013/0010207 | A1 | 1/2013 | Valik et al. | |
| 2013/0084979 | A1 | 4/2013 | Casino et al. | |
| 2013/0121256 | A1 | 5/2013 | Backes et al. | |
| 2013/0157692 | A1 | 6/2013 | Hall et al. | |
| 2013/0296040 | A1* | 11/2013 | Kelly | A63F 13/00 463/29 |
| 2014/0235341 | A1 | 8/2014 | Barney et al. | |
| 2016/0006848 | A1 | 1/2016 | Halvarsson | |
| 2016/0037469 | A1 | 2/2016 | Smith et al. | |
| 2019/0015754 | A1 | 1/2019 | Radu | |
| 2019/0324446 | A1 | 10/2019 | VanderZanden et al. | |

* cited by examiner

700

EXEMPLARY GAME CONSOLE HARDWARE ARCHITECTURE

800

EXEMPLARY GAME NETWORK HARDWARE ARCHITECTURE

900

LASER TAG MOBILE STATION APPARATUS SYSTEM, METHOD AND COMPUTER PROGRAM PRODUCT

CROSS-REFERENCE TO RELATED APPLICATIONS

The present application is a US NonProvisional Application claiming the benefit under 35 USC Section 119(e) of U.S. Provisional Patent Application Ser. No. 62/964,106, filed Jan. 21, 2020, the contents of all of which is incorporated herein by reference in its entirety.

TECHNICAL FIELD OF THE DISCLOSURE

The present disclosure relates generally to laser tag technology. More particularly, the present disclosure relates to an improved automated network of laser tag stations.

BACKGROUND OF THE DISCLOSURE

Related References of the Disclosure

Various conventional systems have been created to provide laser tag games such as, including, Patent Application Publications US20160037469, US20020058459, US20030069077, US20050255842, US20060046606, US20060193283, US20070066395, US2008009345, US20080039204, US20080238937, US20080247408, US20090083847, US20090191968, US20100128653, US20120178529, US20130010207, US20130084979, US20130121256, US20130157692, US20140235341, US20160006848, US20190015754, US20190324446 International Patent Application Publications WO2016019276, W2014185861, WO2015020608 and U.S. Pat. Nos. 2,990,471, 5,044,107, 5,885,129, 6,261,180, 6,752,238 7,076,767, 7,291,014, 7,338,375, 7,500,917, 7,632,187, 7,846,028, 7,872,849, 7,896,742, 7,916,666, 8,462,691, 8,469,824, 8,721,460, 8,837,528, 8,951,128, 9,537,986, 9,692,756, 10,338,679, the contents of all of which are incorporated herein by reference in their entireties.

Conventional systems to manage laser tag units and games are immobile and require hands-on management. They are installed into arenas, buildings, or other facilities, and generally consist of a hub to coordinate data transmission between units and a server to manage games, and separate equipment to charge the units between games. Workers are required to manually dock or undock units or vests onto the chargers, and to manually begin, monitor and end laser tag games. Payments and admittance into the games are conventionally handled manually, and play spaces are created in advance.

What is needed is an improved system for providing laser tag games, which overcomes the shortcomings of conventional solutions.

SUMMARY OF EXEMPLARY EMBODIMENTS OF THE DISCLOSURE

According to an exemplary embodiment of the invention, an exemplary system, method, and/or computer program product for managing a game can include: receiving, by at least one electronic computer processor, a request to establish a game; establishing, by the at least one electronic computer processor, the game can include: authenticating, by the at least one electronic computer processor, a plurality of authorized users; unlocking, by the at least one electronic computer processor, a plurality of unit devices to provide each of the unit devices to each of the plurality of authorized users from at least one station; and/or managing, by the at least one electronic computer processor, the game between the plurality of unit devices.

According to one exemplary embodiment, the method can include where the receiving a request to establish a game can include at least one or more of: receiving, by the at least one electronic computer processor, a request to establish a laser tag game; receiving, by the at least one electronic computer processor, a request of one game from a plurality of available games; and/or receiving, by the at least one electronic computer processor, a request of one game from a plurality of available laser tag games.

According to one exemplary embodiment, the method can include where the authenticating the plurality of authorized users can include: authenticating, by the at least one electronic computer processor, a plurality of users to establish a laser tag game; receiving, by the at least one electronic computer processor, authenticating information from a mobile device; and/or receiving, by the at least one electronic computer processor, confirmation that a payment system has collected electronic payment to allow the plurality of users to play the laser tag game.

According to one exemplary embodiment, the method can include where the station is coupled via a communication network to a service provider computing device.

According to one exemplary embodiment, the method can include where the station is wirelessly coupled to the plurality of unit devices.

According to one exemplary embodiment, the method can further include providing, by the at least one electronic computer processor, for electrically charging the plurality of unit devices via the station.

According to one exemplary embodiment, the method can further include receiving, by the at least one electronic computer processor, the plurality of unit devices back into the station upon completion of the game.

According to one exemplary embodiment, the method can include where managing the game can include at least one of: transmitting, by the at least one electronic computer processor, commands from the station to the plurality of unit devices via the station; coordinating, by the at least one electronic computer processor, play of the game; receiving, by the at least one electronic computer processor, from the plurality of unit devices scores; and/or scoring, by the at least one electronic computer processor, the game.

According to another exemplary embodiment, a system for managing a game can include: at least one service provider system can include: at least one computer processor; and at least one memory coupled to the at least one computer processor; and wherein the at least one computer processor is configured to: receive a request to establish a game; establish the game can include configuring the at least one computer processor to: authenticate a plurality of authorized users; unlock a plurality of unit devices to provide each of the unit devices to each of the plurality of authorized users from at least one station; and/or manage the game between the plurality of unit devices.

According to one exemplary embodiment, the system can include where the at least one station can include a plurality of skates; and at least one station controller coupled to each of the plurality of skates; at least one station memory coupled to the at least one station controller; at least one station energy storage device coupled to the at least one station controller; at least one station energy storage controller coupled to the at least one station controller, the at least one station energy storage device, and the plurality of skates; at least one station radio configured to communicate with each of the plurality of unit devices, and coupled to the at least one station controller; and/or at least one communication network interface for coupling the at least one station to the at least one service provider system, and/or coupled to the at least one station controller.

According to one exemplary embodiment, the system can include where each of the plurality of unit devices is locked or unlocked from one skate of the plurality of skates of the at least one station, and wherein each the one skate can include: at least one skate controller, the at least one skate controller configured to communicatively interact with the at least one station controller; at least one skate memory coupled to the at least one skate controller; at least one radio frequency identification (RFID) reader coupled to the at least one skate controller, the at least one RFID reader configured to read an RFID tag of at least one of the plurality of unit devices; at least one lock coupled to the at least one skate controller, the at least one lock configured to interact with at least one latch of at least one of the plurality of unit devices; and/or at least one skate charger coupled to the skate controller, the at least one charger configured to charge at least one battery of at least one of the plurality of unit devices.

According to one exemplary embodiment, the system can include where the each of the unit devices of the plurality of the unit devices can include: at least one unit device controller; at least one unit device memory coupled to the at least one unit device controller; at least one unit device radio coupled to the at least one unit device controller, the at least one unit device radio configured to communicate with the at least one station radio; at least one unit device energy storage device coupled to the at least one unit device controller and coupled to at least one unit device charge contact configured to interact with the at least one skate charger; at least one unit device latch coupled to the at least one unit device controller and configured to interact with the at least one skate lock; at least one user interface coupled to the at least one unit device controller; and/or at least one location sensor coupled to the at least one unit device controller.

According to one exemplary embodiment, the system can include where the each of the unit devices can include at least one or more of: at least one laser tag unit device; at least one laser tag gun; and/or at least one tool.

According to one exemplary embodiment, the system can include where the unit devices is not a bicycle, each of the unit devices is not an automated scooter, and/or each of the unit devices is not an automobile.

According to one exemplary embodiment, the system can include where the each of the unit devices communicates with the at least one station by radio communication.

According to one exemplary embodiment, the system can include where each of the unit devices communicates with the at least one skate by RFID card reader communication.

According to one exemplary embodiment, the system can include where the each of the at least one skates communicates with the at least one station by i2C protocol communication.

According to yet another exemplary embodiment, an exemplary non-transitory computer accessible medium embodying program code instructions, which when executed by at least one computer processor perform a method for managing a game, wherein the method can include: receiving a request to establish a game; establishing the game can include: authenticating a plurality of authorized users; unlocking a plurality of unit devices to provide each of the unit devices to each of the plurality of authorized users from at least one station; and/or managing the game between the plurality of unit devices, according to an exemplary embodiment.

According to yet another exemplary embodiment, an exemplary system can include where each of the unit devices is a toy and not a vehicle.

According to another exemplary embodiment, an exemplary system can include where each of the unit devices is at least one or more of: is not a vehicle, is a vehicle other than a scooter, is not a scooter, is not an electric scooter, and/or is not a rechargeable scooter.

BRIEF DESCRIPTION OF THE DRAWINGS

The foregoing and other features and advantages of the invention will be apparent from the following, more particular description of various example embodiments of the invention, including any preferred embodiments, as illustrated in the accompanying drawings wherein like reference numbers generally indicate identical, functionally similar, and/or structurally similar elements. The left most digits in the corresponding reference number indicate the drawing in which an element first appears.

DETAILED DESCRIPTION OF EXEMPLARY EMBODIMENTS OF THE INVENTION

Figure 1:
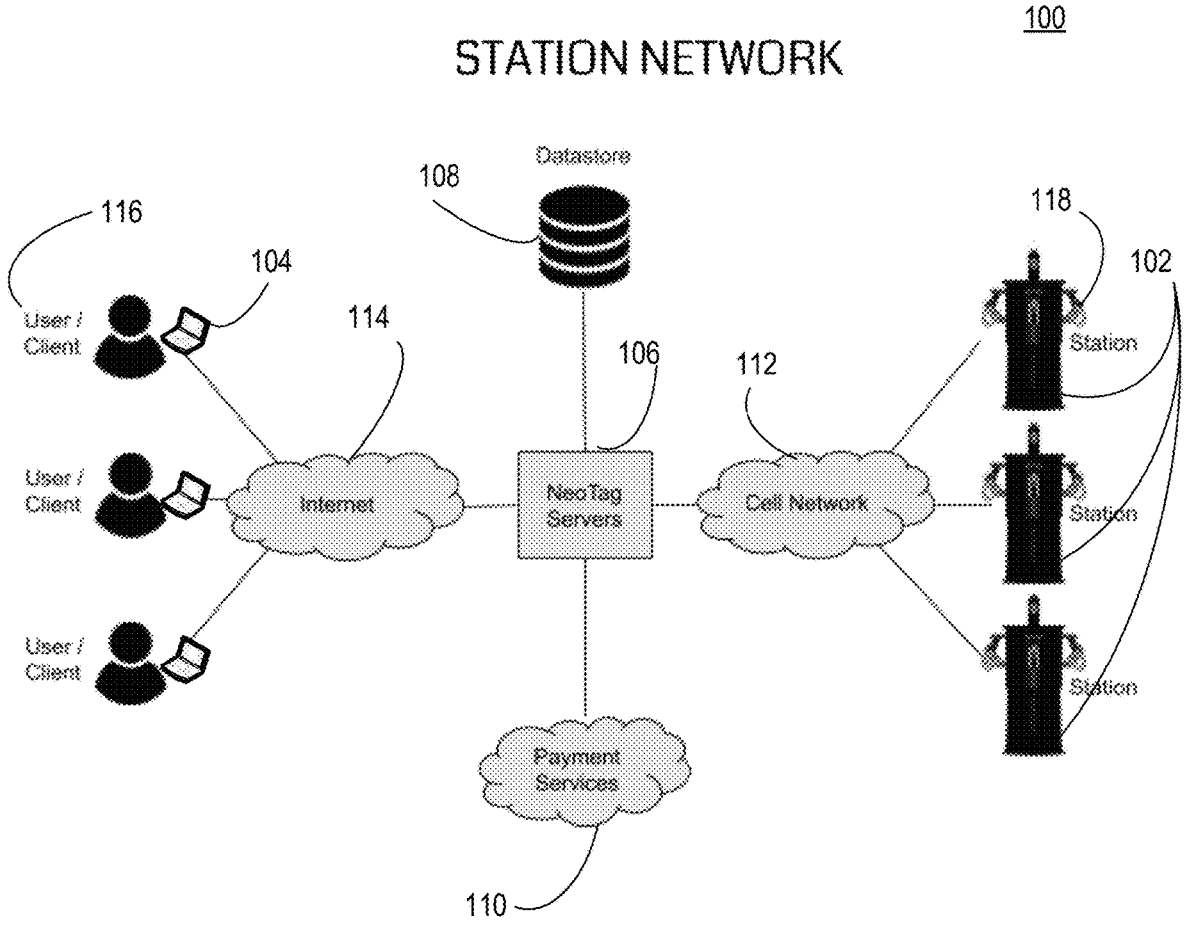
FIG. 1 depicts an exemplary block diagram illustrating how exemplary NEOTAG-branded servers can coordinate communication and transactions between exemplary users and exemplary stations, according to an exemplary embodiment.

FIG. 1 depicts an exemplary block diagram illustrating how exemplary NEOTAG-branded servers can coordinate communication and transactions between exemplary users and exemplary stations, according to an exemplary embodiment. FIG. 1 includes a station network 100 diagram illustrating exemplary web infrastructure that can be configured to facilitate communication between exemplary station(s) 102, client(s) 104, server(s) 106, datastore(s) 108, and payment service(s) 110, according to an exemplary embodiment. According to an exemplary embodiment, various exemplary components of station network 100 can be coupled together by one or more communication networks, including, e.g., but not limited to, an exemplary communication network 112 (which can be an exemplary wireless and/or cellular network, for example), and/or exemplary communications network such as, e.g., but not limited to, a data network, such as, e.g., a global Internet communication network 114, etc., according to exemplary embodiments.

Client(s) 104 refer to an exemplary user device 104 of a user 116 and/or an associated networked user application such as, e.g., but not limited to, a web-page/web-application, and/or mobile application that an exemplary user(s) 116 can interact with that communicates with the exemplary server(s) 106, according to an exemplary embodiment. The client(s) 104 can allow the user(s) to communicate with the servers 106 in order to, e.g., but not limited to, register an account, log in with that account, register payment information, complete transactions with an exemplary NeoTag application service provider system (as, e.g., may be provided over the example station network 100 illustrated), find nearby station(s) 102, join a queue of a given station 102, be assigned a unit 118 (discussed further below with reference to 202 in FIG. 2), join an ongoing game, monitor existing games, track data from past games, and interact with other Users 116, according to an exemplary embodiment.

Server(s) 106 refer to an exemplary networked machine and/or computer and/or virtual machine and/or computer, that can be configured to host exemplary web server software, and/or application software that can be configured to allow for communication between exemplary clients 104, exemplary stations 102, the exemplary datastore(s) 108, and exemplary payment services 110, according to an exemplary embodiment. The server(s) 106, according to an exemplary embodiment, can coordinate the following exemplary, but nonlimiting, tasks, according to an exemplary embodiment:

- registration of users 116 and/or user device(s) 104 (which can include a communication and/or computing device such as, e.g., but not limited to, a laptop, mobile phone, network accessible browser based device, etc.),
- payment or transactions between the users 116 and the station network 100,
- authorization and/or authentication of user(s) 116 to unlock unit(s) 118,
- tracking and/or management of stations 102 and units 118,
- tracking and/or management of data from exemplary activities of the units 118, such as, e.g., but not limited to, games, other activities, etc.

Datastore(s) 108 refer to an exemplary networked machine(s) and/or computer(s) and/or virtual machine(s) and/or computer(s), running exemplary database software (such as, e.g., but not limited to, an exemplary relational database, an exemplary flat file database, an exemplary hierarchical database, an exemplary graph database, etc.) that allow the storage of data needed by the web applications running on the exemplary server(s) 106, according to an exemplary embodiment.

Payment Services 110 refer to an exemplary external (or internal) service or business that the servers 106 can communicate with to facilitate payments and financial transactions between Users 116, via user devices 104 and NeoTag devices 106, 108 for services provided by NeoTag devices and the Stations 102, according to an exemplary embodiment. According to an exemplary embodiment, payment service 110 can be any of various well known electronic and/or online payment services including, e.g., but not limited to, PAYPAL, VENMO, WEPAY, SHOPIFY, AMAZON PAYMENTS, PAYPAL PAYMENTS, AUTHORIZE.NET, 2CHECKOUT, DWOLLA, STRIPE, WORLDPAY, SIMPLIFY COMMERCE, APPLE PAY, ANDROID PAY, MASTERPASS, payment gateways, mobile payments services, social media platform-based services, messenger-based services, block-chain ledger based systems, crypto-currency based payment systems, e-commerce based systems, direct deposit, electronic funds transfer (EFT), automated clearinghouse (ACH), merchant e-solutions, debit, charge, credit, creditcard, smartcard, cash value card, prepaid card, and/or bankcard, payment gateways, electronic payment system, e-commerce payment system, B2C payment systems, B2B payment systems, CTX and CCD transactions, recurring payment systems, PPD transactions, subscription payment systems, financial cybermediaries, electronic checks, electronic bill presentment, ewallets, direct deposit, currency equivalents, etc.

Figure 2:
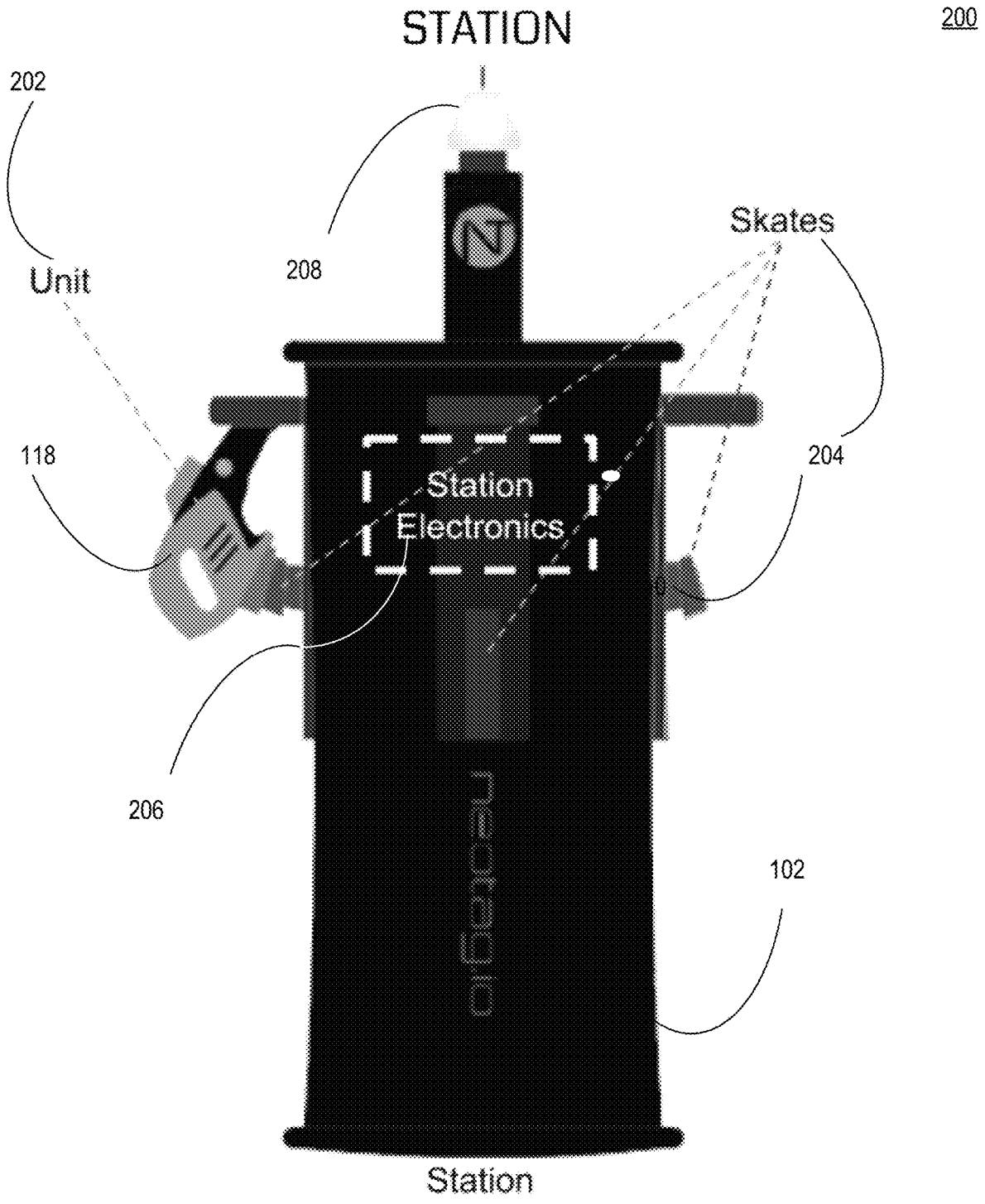
FIG. 2 depicts an example embodiment of an exemplary station with exemplary skate(s) and unit(s), coupled thereto, according to an exemplary embodiment.

FIG. 2 depicts an example embodiment an exemplary diagram 200 of an exemplary station 102 with exemplary skate(s) 204 and unit(s) 118, removably coupled thereto, according to an exemplary embodiment.

A "Station" 102, according to an exemplary embodiment, can be a mobile platform or structure which can has multiple exemplary slots or "Skates" 204 that exemplary "Units" 118, shown in a docked unit configuration 20, 2 can be removably coupled, securely to "Dock" as illustrated in (FIG. 2), according to an exemplary embodiment. A Station 102, according to an exemplary embodiment, can run and manage the exemplary Units 118, 202 that can be Docked and/or assigned to the station 102, according to an exemplary embodiment. Exemplary unit(s) 118, 202 can include an exemplary handle, can include any of various other components such as, e.g., but not limited to, exemplary sensors for receiving input, output devices such as, e.g., but not limited to light emitting diodes (LED), and/or infrared and/or radio frequency input/output transmission/receiver/transceiver devices, and/or may be shaped as an exemplary laser tag device and/or toy weapon and/or phaser device, etc., and supporting electronics and components, according an exemplary embodiment. According to another exemplary embodiment, other types of units may be provided such as, e.g., but not limited to, exemplary tools, and/or other handheld devices capable of removable coupling and shared usage from an exemplary shared station 102 accessible via an exemplary handle on the unit 118, 202 from exemplary skates 204, according to an exemplary embodiment. The Station 102 can communicate with each of an exemplary plurality of exemplary Skates 204, to track the status of any Docked Units 118, 202, according to an exemplary embodiment. The exemplary station 102 can also coordinate data transfer wirelessly between the station 102 and the Units 118, 202 and between the station 102 and an exemplary wide area network (WAN), such as, e.g., but not limited to, the internet and/or other communication network in order to, according to an exemplary embodiment:

- track and manage location and status of the exemplary Units 118, 202, and/or
- unlock Units 118, 202 from exemplary Skates 204, and/or
- send and/or receive (i.e., transmit, receive, transceiver, etc.) various data to and from the exemplary Servers 106, and/or
- obey and/or execute commands and/or other operations from the Servers 106 to, e.g., but not limited to, manage the function of Units 118 and Skates 204 assigned to the Station 102, according to an exemplary embodiment.

According to an exemplary embodiment, station 102 can include, e.g., but not limited to, an exemplary antenna, and/or light emitting diode (LED), and/or other light generating element 208, which can be illuminated atop exemplary station 102, as illustrated in diagram 200, according to one exemplary embodiment. Exemplary element 208 can communicate different forms of exemplary information via, e.g., but not limited to, a color, a state of blinking, strobing, etc., according to an exemplary embodiment.

According to an exemplary embodiment, new games and new software updates can be transmitted, e.g., wirelessly, through an exemplary network, and can be made available, e.g., for a monthly subscription, as an exemplary periodically billed service, according to an exemplary embodiment.

Figure 3:
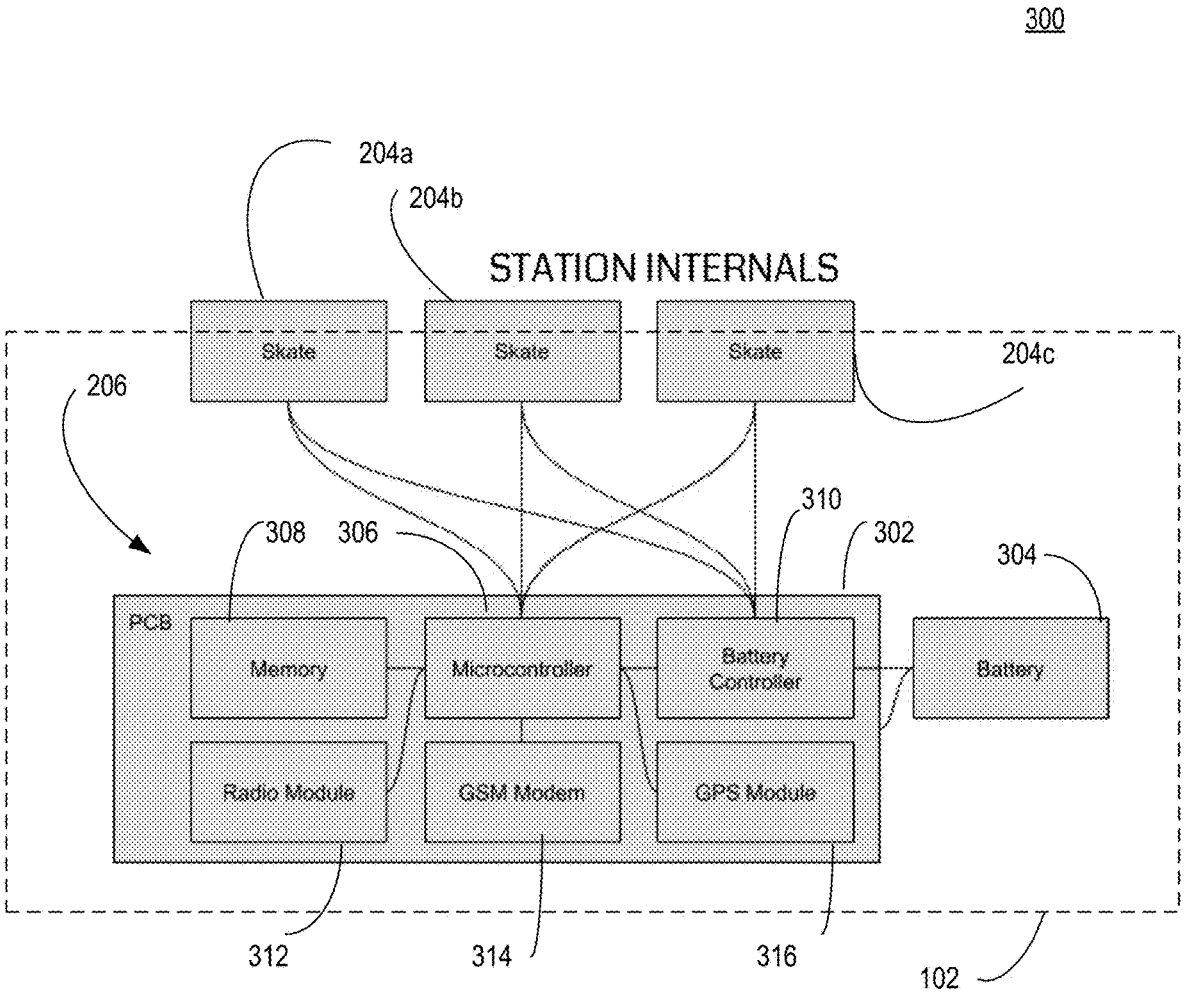
FIG. 3 depicts an exemplary block diagram illustrating an exemplary embodiment of example internals of an exemplary station, exemplary electronic component(s) of the station, and an example of how an embodiment can connect or couple these components to one another, according to an exemplary embodiment.

FIG. 3 depicts an exemplary block diagram 300 illustrating an exemplary embodiment of example internals, according to an exemplary embodiment, of an exemplary station 102, including, e.g., but not limited to, station electronics 302, which can include one or more exemplary electronic and/or other exemplary hardware component(s) of the station, which according to an exemplary embodiment can include one or more printed circuit boards (PCBs), and an example of how an exemplary embodiment can connect and/or couple various exemplary components to one another, is illustrated, according to an exemplary embodiment.

The Station 102, according to an exemplary embodiment, can be configured to include, exemplary features enabling being weather resistant, configured for exemplary outdoor use in exemplary variable weather environments, and/or can be deployed indoors and/or outdoors and exemplary embodiments can contain an exemplary large battery 304 and/or other power source or supply to, e.g., power the exemplary station 102, itself, and/or external devices, according to an exemplary embodiment. The exemplary Station 102, according to one exemplary embodiment, can contain, according to an exemplary embodiment, various internal exemplary but nonlimiting internal components, including, e.g., but not limited to: (see FIG. 3)

- exemplary components to communicate with exemplary wireless communication networks such as, e.g., but not limited to, Cell Network(s) 112, or the like,
- an exemplary Radio module 312, to communicate with exemplary Units 118, 202,
- exemplary Battery 304 (or other energy storage device, and/or energy generation and/or production module, such as, e.g., but not limited to, a power supply coupled to an electric grid, a solar panels, wind turbine, fuel cells, inverters, controllers, microgrid, and/or other renewable energy supplies) to power the station 102.
- exemplary Skates 204*a*, 204*b*, 204*c* (collectively 204) for enabling exemplary mechanical and/or electrical coupling and/or electronic coupling and/or docking and/or locking, etc.,
- exemplary hardware to, e.g., transmit and/or charge/recharge an exemplary power supply and/or exemplary energy storage device in an exemplary removably coupled unit 118, 202 via exemplary Skates 204,
- exemplary hardware useful and/or necessary to communicate/transfer data to and/or from the Skates 204, and/or
- an exemplary programmable Microcontroller 306 and/or Memory 308 coupled thereto, to execute and/or run software and/or hardware and/or other instructions to execute, by the at least one electronic computer processor, exemplary tasks including the exemplary above illustrated tasks, according to an exemplary embodiment.

The exemplary station electronics 302 can include, e.g., but not limited to, an exemplary GPS module for location and/or position identification, radio module(s) 312 for enabling communications, exemplary GSM modem 314, 3G, 4G, 5G, and/or nG modem for exemplary communications to an exemplary GSM and/or other wireless communications network, an exemplary energy controller 310, which can include an exemplary battery controller or other energy system controller configured to enable charging and/or discharging of battery 304 and/or batteries in exemplary removably coupled units 118, 202 via exemplary skates 204, according to an exemplary embodiment.

Figure 4:
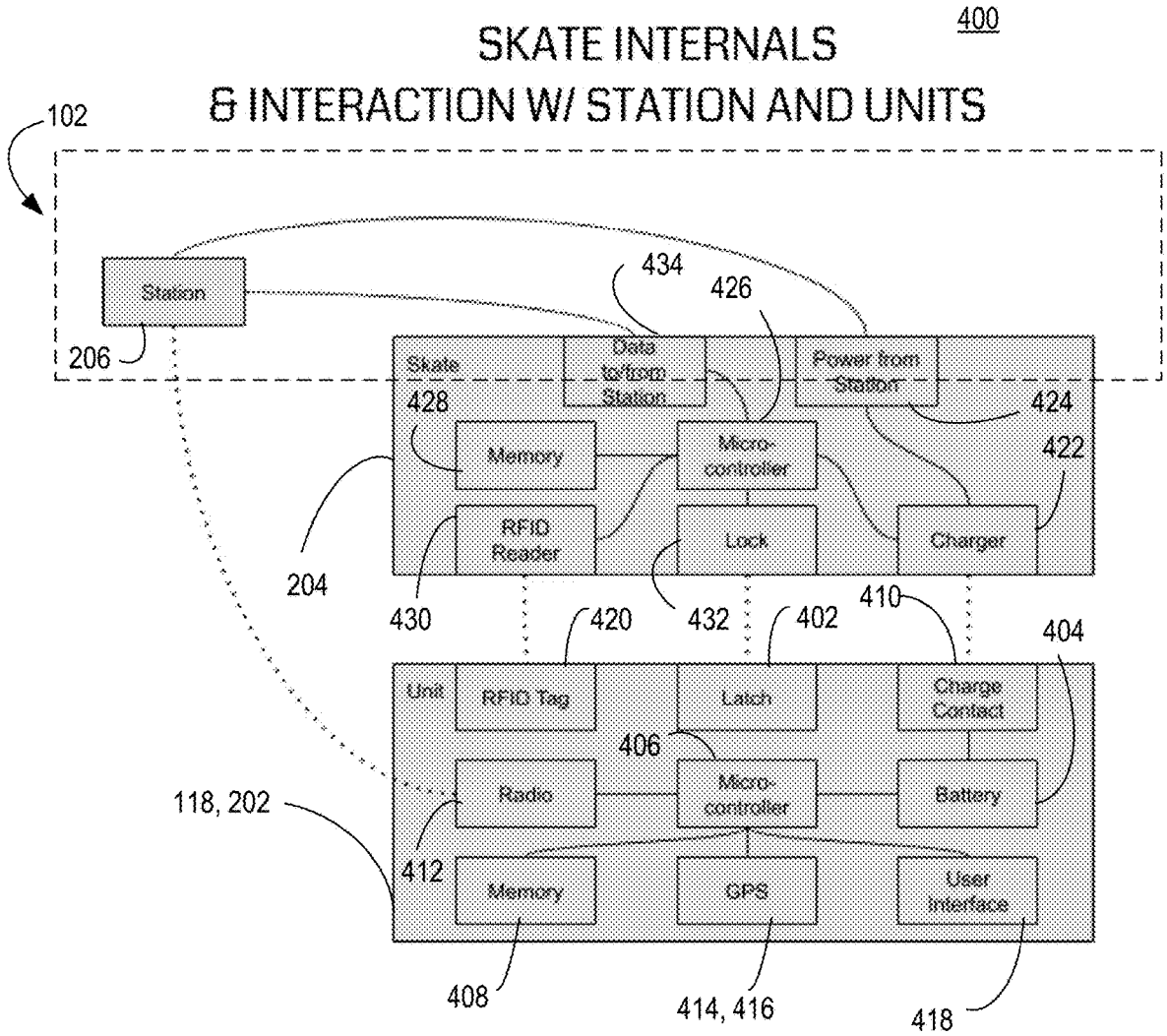
FIG. 4 depicts an exemplary block diagram illustrating an exemplary embodiment of example internals of an exemplary skate and an exemplary unit, and how the exemplary internals can interact with each other and the example station, according to one exemplary embodiment.

FIG. 4 depicts an exemplary block diagram 400 illustrating an exemplary embodiment of example internals of an exemplary skate(s) 204 and an exemplary unit 118, 202, and how the exemplary internals can interact with each other and the example station, according to one exemplary embodiment.

Exemplary unit 118, 202 can include, according to an exemplary embodiment, a controller 406 such as, e.g., but not limited to, a microcontroller, processor, or the like, an exemplary radio 412, memory 408, GPS and/or other location and/or position sensor system 414, 416, user interface 418, battery and/or external batter interface/charging contacts 410, locking latch 402, and/or identification and/or ID and/or radio frequency identifier (RFID) tag 420, according to an exemplary embodiment.

An exemplary "Skate" 204, can include, according to an exemplary embodiment, exemplary internal components 434, which may be part of the skate 204 and/or station 206, according to exemplary embodiments. Exemplary internal components 434 can include, according to an exemplary embodiment of skate 204, a controller 426 such as, e.g., but not limited to, a microcontroller, etc., an exemplary memory 428 coupled to the exemplary controller 426, as well as other components such as, e.g., but not limited to, exemplary data coupling and/or transceiver, transmitter/receiver, for communication to and/or from station 102 electronic 206, and or power interface and/or mechanical and/or electric coupling to provide power to exemplary skate 204 from exemplary station 206 and/or other source of energy and/or power such as, e.g., an energy storage device 304 and/or generation and/or production system (not shown), an exemplary RFID reader 430, an exemplary lock 432, and/or exemplary charger 422, etc.

Exemplary "Skate" 204, according to an exemplary embodiment, can include, e.g., but not limited to, an exemplary mechanical slot, and/or lock and/or latching mechanism, and/or other mechanism, etc., according to an exemplary embodiment, on the Station 102, which can allow, e.g., but not limited to, for an exemplary given Unit 118, 202 to be Docked to a respective skate 204 and the exemplary electronics illustrated in exemplary diagram 400 and/or exemplary mechanical mechanisms to, according to an exemplary embodiment, facilitate the exemplary Locking, Unlocking, Charging, and/or Identification of, an exemplary Unit 118, 202 Docked to the skate 204 (as shown in FIGS. 1-4), according to an exemplary embodiment. The skate 204 can in an exemplary embodiment be integrated with the station 102, and/or may be a separate component coupled to the station 102, according to exemplary embodiments. Exemplary skate 204 and/or portions of station 102 and/or station internals 206 can, according to an exemplary embodiment, can house an exemplary radio frequency identifier (RFID) reader 430 and/or other close-range wireless-communications module such as, e.g., but not limited to, passive RFID, active RFID, smartcard, smartchip, near field communication (NFC), BLUETOOTH, WIFI, WIMAX, and/or other wireless communication, etc., that can read the exemplary RFID tag 420 of an exemplary unit, and/or other identifier such as, e.g., but not limited to, other RFID, UPC, barcode, two dimensional, three dimensional and/or more dimensional barcode, QR code, biometric, and/or other form of ID from the exemplary Unit 118, 202, when the unit 118, 202 is Docked to the Skate 204, according to an exemplary embodiment. The Skate 204, according to an exemplary embodiment, can contain, e.g., but not limited to, charging hardware to, according to an exemplary embodiment, charge the exemplary Unit 118, 202 when Docked, according to an exemplary embodiment. The Skate 204, according to an exemplary embodiment, can house an exemplary Lock, and/or other mechanism which can securely and/or removably lock/unlock the exemplar Unit 118 to the exemplary skate 204 when Docked and/or coupled and/or connected, so the exemplary unit 118, 202 cannot be removed until electronically instructed to do so by the exemplary Station 102, according to an exemplary embodiment. The Skate 204, according to an exemplary embodiment, can communicate various exemplary data to and/or from the device including, e.g., but not limited to, the lock state, battery state, location, RFID, and/or identity data, etc., to and/or from the exemplary Station 102 and/or station electronics 206, according to an exemplary embodiment. By using the provided data from the skate 204, according to an exemplary embodiment, the Station 102, 206 can command, according to an exemplary embodiment, the Skate 204 to, e.g., but not limited to, Unlock, and/or lock, and/or to begin and/or to end charging, according to an exemplary embodiment.

According to an exemplary embodiment, being "Docked" and/or "Docking" can be a state that an exemplary Unit 118, 202 is in when securely attached and/or locked via exemplary lock 432 of the exemplary skate 204, and/or latch 402 of an exemplary unit 118, 202, to the exemplary Skate 204 of an exemplary Station 102, according to an exemplary embodiment. This means that, according to an exemplary embodiment, while docked, an exemplary Unit 118, 202 cannot be physically removed by use of lock 432 and/or latch 402 mechanisms, until, e.g., but not limited to, authorized and/or Unlocked, according to an exemplary embodiment. While exemplary unit(s) 118, 202 are docked, according to an exemplary embodiment, the Station 102 can, e.g., but not limited to, charge the battery 404 of unit 118, 202 via charge contact 410 being coupled to and/or connected to exemplary charger 422 of skate 204, and can, e.g., but not limited to, detect which Unit 118, 202 is Docked to which Skate 204, according to an exemplary embodiment. According to one exemplary embodiment, charging can be performed via a conductive electronic connection, and/or via another exemplary embodiment, the charging can occur via other means such as, e.g., but not limited to, inductive charging, Qi-enabled charging, Chi wireless charging, resonant charging, charging via induction coils, wireless and/or other wired mechanisms, etc.

An exemplary Station 102 can include, exemplary "Coordinated Communication"—Between exemplary Units 118, 202—The exemplary Station 102, according to an exemplary embodiment, can contain an exemplary radio 312 to, e.g., but not limited to, communicate to exemplary respective Units 118, 202 via radio 412, to query for information from them such as, e.g., but not limited to, GPS location, which can be sensed from exemplary GPS 414, 416, battery charge of exemplary battery 404 and/or other information received from microcontroller 406 in communication over its radio 412, and/or any application specific data running on the Units 118, 202, etc., according to an exemplary embodiment. The Station 204 can also facilitate communication between the Units 118, 202 by, e.g., but not limited to, acting as a hub that the Units 118, 202 can use to relay data to each other via exemplary skate 204 and/or station 102, and/or peer to peer between units 118, 202, if so configured, according to an exemplary embodiment.

According to an exemplary embodiment, an exemplary station 102 can include mechanisms for providing exemplary communication—between one or more station(s) 102 and/or servers and/or on a peer to peer basis between stations via an exemplary communication and/or wide area network (WAN). The Station 102, according to an exemplary embodiment, can contain an exemplary GSM module 314 and/or other network communications hardware device and/or chip and/or accompanying software communications stack and/or the like, to allow exemplary transfer (receive and/or transmit) of exemplary data between the exemplary Station 102 and the exemplary wireless network 112 such as, e.g., but not limited to, cell network, WIFI, WIMAX, GSM, CDMA, 3G, 4G, 5G, nG, etc., and/or other wireless and/or wide area network (WAN), specifically to communicate with the exemplary NeoTag Servers 106, 108, 110 and/or Station 102 Network 112, 114, 110, according to an exemplary embodiment.

Figure 5:
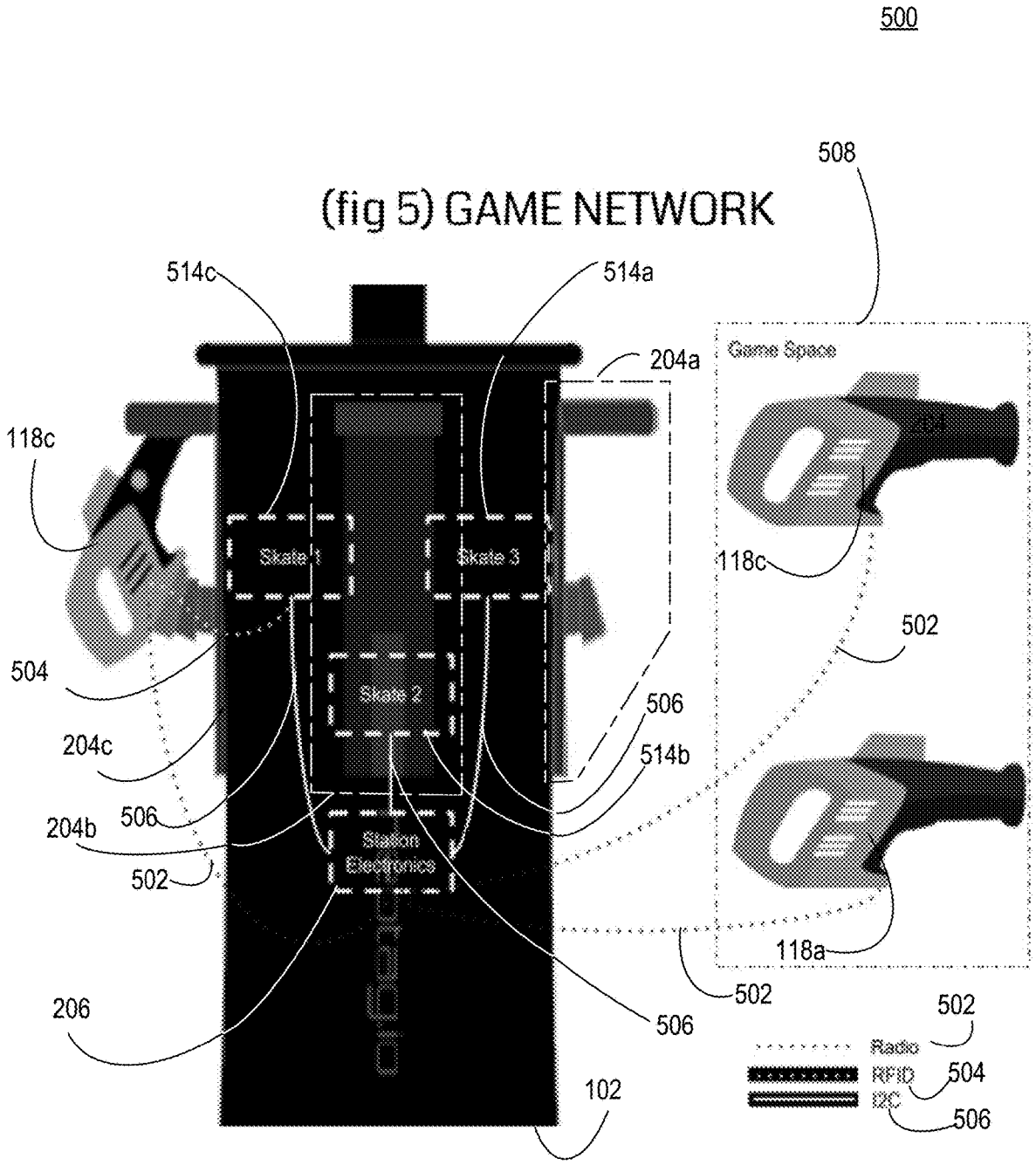
FIG. 5 depicts an example diagram of exemplary communication between an example embodiment of an example station, example skates, and example units during a game, according to various exemplary embodiments.

FIG. 5 depicts an exemplary "Unit" 118, 202, which as defined here, and shown in exemplary diagram 500, according to an exemplary embodiment, can include any electronic device which can be designed to Dock to an exemplary Station 206 Skate 204 and/or is capable of communicating with both the Skate 204 and/or Station 102 (including exemplary internal components as illustrated in FIG. 4 for example), according to an exemplary embodiment. Units 118, 202, according to an exemplary embodiment, can generally include, e.g., but are not limited to, exemplary handheld user-controlled devices 118*a*, 118*b*, 118*c* (collectively 118) that can be used, according to an exemplary embodiment, in the vicinity of the Station 102 before being re-Docked, according to an exemplary embodiment. The Unit 118, 202, according to an exemplary embodiment, can contain as illustrated in FIG. 4, according to an exemplary embodiment:

- an exemplary Radio 412 for communication with the Station 102, and/or
- an exemplary RFID tag 420 to identify the unit 118, 202 when Docked, and/or
- an exemplary Latch 402 to allow the unit 118, 202 to be Locked to the Skate 204 when Docked, and/or
- an exemplary Battery 404 and/or exemplary components 410 to allow charging of the Battery 404 when Docked, and/or
- an exemplary GPS module 414, 416 so the location of unit 118, 202, can be sensed, and/or communicated to the Station 102, and/or
- an exemplary programmable Microcontroller 406 and/or Memory or other electronic storage device 408, to execute/run software and/or other instructions such as, e.g., but not limited to, software, middleware, microcode, and/or other instructions, to execute the exemplary above tasks.

The unit 118, 202, can be a unit 118, 202 available from an entity NEOTAG, INC. of Baltimore, Md., USA. The "NeoTag Unit" 118, 202, according to an exemplary embodiment, is an implementation, or example embodiment, of the Unit 118, 202 defined above that can be used to play exemplary but nonlimiting laser tag games, or the like, according to an exemplary embodiment. In addition to the exemplary attributes listed above, an exemplary NeoTag Unit 118, 202 can contain components for exemplary feedback and/or interaction with the User 116 via an exemplary user interface 418, which may include, e.g., but may not be limited to, exemplary buttons, light emitting diodes (LEDs), an exemplary liquid crystal display (LCD) and/or organic light emitting diode (OLED), or the like display screen and/or monitor, an exemplary acoustic speaker, and/or a rumble/haptic/tactile/vibration device and/or motor, according to an exemplary embodiment.

FIG. 5 depicts an example diagram 500 illustrating exemplary communication between an example embodiment of an example station 102, example one or more skates 204, and example units 118, 202 during an exemplary game, according to an exemplary embodiment.

Dotted line 502 represents an exemplary wireless communication via radio between units 118 and station electronics 206 of station 102, according to an exemplary embodiment. Referring to FIGS. 3, 4 and 5 together, exemplary NeoTag Units 118, 202 can also contain, according to an exemplary embodiment, an exemplary focused infrared LED and/or infrared sensors and/or input devices and/or output devices as may be well known on an exemplary laser tag device, according to an exemplary embodiment, (not shown in FIG. 4), and, according to an exemplary embodiment, can use the exemplary sensors along with the Radio 412 to, according to an exemplary embodiment, send/receive and/or synchronize game data and/or scores, etc., with other units 118, 202 and/or with the Station(s) 102, according to an exemplary embodiment. The Station 102, according to an exemplary embodiment, can send/receive commands and/or data to/from the Units 118, 202 through station Radio 312 to radio 412 of unit 118, 202, according to an exemplary embodiment, to change the outputs of the Unit 118, 202 such as, e.g., but not limited to, LCD display(s), LED color(s), etc., according to an exemplary embodiment. Station 102, according to an exemplary embodiment, can also query unit(s) 118, 202 for exemplary inputs from the Unit 118, 202 such as, e.g., but not limited to GPS location from exemplary GPS 414 position and/or location subsystem 416, and can, according to an exemplary embodiment, send commands and/or other instructions to, e.g., but not limited to, begin and/or end games, and/or begin and/or end sessions, etc., according to an exemplary embodiment.

According to an exemplary embodiment, exemplary station 102 can include exemplary station electronics 206, which can communicate with various exemplary skate(s) 204 via an exemplary communication protocol such as, e.g., but not limited to, I2C protocol, and/or other wired and/or wireless protocol and/or communications methodology.

For example, according to an exemplary embodiment, as illustrated by line 506, station electronics 206 can communicate by i2C protocol with skate 3 204*a* skate electronics 514*a*. Similarly, according to an exemplary embodiment, as illustrated by line 506, station electronics 206 can also communicate by i2C protocol with skate 2 204*b* skate electronics 514*b*. Finally, according to an exemplary embodiment, as illustrated by line 506, station electronics 206 can also communicate by i2C protocol with skate 1 204*c* skate electronics 514*c*. Skate 204*a*, illustrates an exemplary side orthographic view of exemplary skate 204*a*, and skate 204*b* illustrates an exemplary front orthographic view of an exemplary skate 204*b*, according to an exemplary embodiment.

Figure 6:
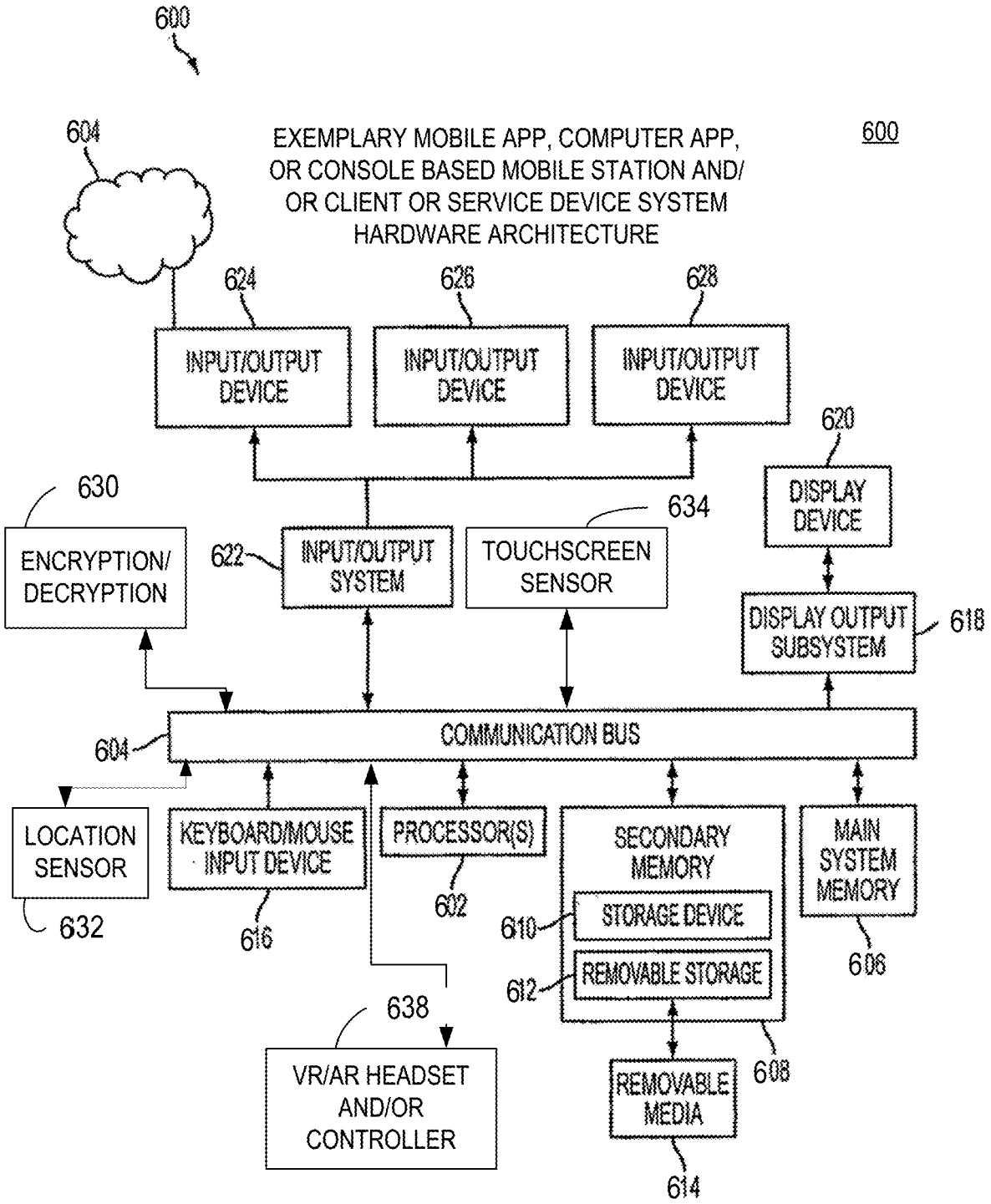
FIG. 6 depicts an exemplary schematic block diagram illustrating an exemplary computer/communications device hardware architecture as may be used in various components of an exemplary embodiment including example servers, example stations, example skates, example units, example mobile devices, example cloud-based computing devices, example content servers, example web servers, example database servers and/or other example application servers, according to an exemplary embodiment.

FIG. 6 depicts an exemplary schematic block diagram illustrating an exemplary computer/communications device hardware architecture as may be used as, or in any of, or in combination with any of, various components of an exemplary embodiment including example servers 106, 108, systems 110, networks and network systems 110, 112, 114, example user devices 104, example stations 102, example skates 104, example units 118, 202, example mobile devices 104, example computing devices 104, example cloud-based computing devices, example content servers, example web servers, example browser-based devices, thick clients, thick clients, databases, datastores, example database servers, NEOTAG Servers, networks, cell networks, WANs/LANs, charging devices, routers, switches, communication systems, wired and/or wireless, electronic and/or optical, CISC, RISC, POWER, multiprocessor, multicore, dualcore, quadcore, octocore, hexacore, ncore, smart television, smart device, Internet of Things (IoT), biometric, sensor-based, I/O devices, Voice over IP (VoIP) device, relational database devices, graph database systems, social networking devices, payment system devices, ecommerce system devices, distributed ledger, block/chain systems, cryptological systems, encryption/decryption devices, cryptocurrency, controller, microcontroller, system on a chip (SOC) devices, think and thick devices, client/server, peer-to-peer, host-based, cloud-based, and/or other example application servers, according to an exemplary embodiment.

FIG. 6, discussed further below, depicts an exemplary computer system as can be used as a client, or server, web server, application server, and/or any other of the computing and/or communications devices, etc., whether, or not, included in the other drawing figures, according to various exemplary embodiments. FIG. 6 depicts an exemplary diagram 600 illustrating an exemplary computer/communications device hardware architecture as may be used in various components of exemplary embodiments of the present invention. FIG. 6 depicts an exemplary view 600 of an exemplary computer system 102, 104, 106, 108, 110, 112, 114 as may be used in implementing an exemplary embodiment of the present invention. FIG. 6 depicts an exemplary embodiment of a computer system that may be used in computing devices such as, e.g., but not limited to, station device 102, user device 104, and/or server device 106, datastore 108, other systems 112, 114, 110, 118, according to an exemplary embodiment of the present invention. FIG. 6 depicts an exemplary embodiment of a computer system that may be used as client device 104, or a server device 102, 118, 106, 108, 110, 112, 114, etc. The present invention (or any part(s) or function(s) thereof) may be implemented using hardware, software, firmware, or a combination thereof and may be implemented in one or more computer systems or other processing systems. In fact, in one exemplary embodiment, the invention may be directed toward one or more computer systems capable of carrying out the functionality described herein. An example of a computer system 600 is shown in FIG. 6, depicting an exemplary embodiment of a block diagram of an exemplary computer system useful for implementing the present invention. Specifically, FIG. 6 illustrates an example computer 600, which in an exemplary embodiment may be, e.g., (but not limited to) a personal computer (PC) system running an operating system such as, e.g., (but not limited to) WINDOWS MOBILE™ for POCKET PC, or MICROSOFT® WINDOWS® NT/98/2000/XP/CE/7/8/10, etc. available from MICROSOFT® Corporation of Redmond, Wash., U.S.A., SOLARIS® from SUN® Microsystems of Santa Clara, Calif., U.S.A, OS/2 from IBM® Corporation of Armonk, N.Y., U.S.A, Mac/OS, Mac OSX, iOS, from APPLE® Corporation of Cupertino, Calif., U.S.A, etc, or any of various versions of UNIX® (a trademark of the Open Group of San Francisco, Calif., USA) including, e.g., LINUX®, HPUX®, IBM AIX®, and SCO/UNIX®, etc., Android OS from Google, Java from Oracle, etc. However, the invention may not be limited to these platforms. Instead, the invention may be implemented on any appropriate computer system running any appropriate operating system. In one exemplary embodiment, the present invention may be implemented on a computer system operating as discussed herein. An exemplary computer system, computer 600 is shown in FIG. 6. Other components of the invention, such as, e.g., (but not limited to) a computing device, a communications device, a telephone, a personal digital assistant (PDA), a personal computer (PC), a handheld PC, client workstations, thin clients, thick clients, proxy servers, network communication servers, remote access devices, client computers, server computers, routers, web servers, data, media, audio, video, telephony or streaming technology servers, a tablet, a phone, a mobile phone, a cellular phone, a communications device, an iPhone, iOS, MACOS, OSX, OSn, a smartphone, an iPad, a tablet based device, an ANDROID OS device, an iOS device, a Symbian based device, a Windows 8, 10, etc., device, etc., may also be implemented using a computer such as that shown in FIG. 6, according to an exemplary embodiment.

The computer system 600, according to an exemplary embodiment, may include one or more processors, such as, e.g., but not limited to, processor(s) 604, which may include microprocessors, coprocessors, multiprocessors, nanoprocessors, microcontrollers, systems on a chip (SOC), multiprocessor systems, parallel processors, CISC type processors, RISC type processors, POWER type processors, ARM-architecture processors, massively parallel processor, graphic processors (GPUs) 632, cryptographic processors such as, e.g., but not limited to, encryption/decryption processor 636, quantum computers, etc. The processor(s) 604 may be connected to a communication infrastructure 606 (e.g., but not limited to, a communications bus, crossover bar, or network, etc.). Various exemplary software embodiments may be described in terms of this exemplary computer system. After reading this description, it will become apparent to a person skilled in the relevant art(s) how to implement the invention using other computer systems and/or architectures.

Computer system 600 may include display 620, a display interface or subsystem 618, coupled to a communications bus 604, the display interface 618 may forward, e.g., but not limited to, graphics, text, and other data, etc., from the communication infrastructure 604 (or from a frame buffer, etc., not shown) for display on the display unit 620, and/or GPU not shown, and/or touchscreen 634, and/or other input or output, and/or input and output devices 624, 626, 628, sensor based device, network connected interface or communications network or cloud 604, keyboard device 616, location sensor 632, keyboard mouse/stylus/input device 616, VR/AR headset and/or controller 638, etc.

The computer system 600, according to an exemplary embodiment, may also include, e.g., but may not be limited to, a main memory 606, random access memory (RAM), and a secondary memory 608, etc. The secondary memory 608 may include, for example, (but not limited to) a storage device 610 such as, e.g., but not limited to, hard disk drive 610 and/or a removable storage drive 614, representing a floppy diskette drive, a magnetic tape drive, an optical disk drive, a compact disk drive (CD-ROM), digital versatile disc (DVD), universal serial bus storage device (USB), FLASH memory storage device, solid state memory device (SSD), memory card, SDRAM card, Personal Cloud storage, redundant array of inexpensive disks (RAID) array, etc. The removable storage drive 614 may, e.g., but not limited to, read from and/or write to a removable storage unit 618 in a well-known manner. Removable storage unit 612, also called a program storage device or a computer program product, may represent, e.g., but not limited to, a floppy disk, magnetic tape, optical disk, compact disk, etc. which may be read from and written to by removable storage drive 614. As will be appreciated, the removable storage unit 614 may include a computer usable storage medium having stored therein computer software and/or data, according to an exemplary embodiment.

In alternative exemplary embodiments, secondary memory 608, 610, 612, 614 may include other similar devices for allowing computer programs or other instructions to be loaded into computer system 600. Such devices may include, for example, a removable storage unit 614 and an interface 612. Examples of such may include, e.g., but not limited to, a program cartridge and cartridge interface (such as, e.g., but not limited to, those found in video game devices), a removable memory chip (such as, e.g., but not limited to, an erasable programmable read only memory (EPROM), or programmable read only memory (PROM) and associated socket, and other removable storage units 614 and interfaces 612, which may allow software and data to be transferred from the removable storage unit 614 to computer system 600, according to an exemplary embodiment.

Computer 600 may also include an input device such as, e.g., (but not limited to) a mouse or other pointing device such as a digitizer, and a keyboard or other data entry device (none of which are labeled), according to an exemplary embodiment.

Computer 600 may also include output devices, such as, e.g., (but not limited to) display 620, and display interface 618. Computer 600 may include input/output (I/O) devices such as, e.g., (but not limited to) communications interface 622, 624, 604, cable and/or other physical medium, not shown and communications path 622, 624, 604, etc. These devices may include, e.g., but not limited to, a network interface card, and modems (neither are labeled), according to an exemplary embodiment. Communications interface may allow software and data to be transferred between computer system 600 and external devices. Examples of communications interface 624 may include, e.g., but may not be limited to, a modem, a network interface (such as, e.g., an Ethernet card), a communications port, a Personal Computer Memory Card International Association (PCMCIA) slot and card, etc. Software and data transferred via communications interface 624 may be in the form of non-transitory signals 628 which may be electronic, electromagnetic, optical or other signals capable of being received by communications interface. These signals may be provided to communications interface 622, 624 via, e.g., but not limited to, a communications path 624 (e.g., but not limited to, a channel). This channel 624 may carry signals, which may include, e.g., but not limited to, propagated signals when non-transitory, and may be implemented using, e.g., but not limited to, electronic, optical, wire or cable, fiber optics, a telephone line, a cellular link, an radio frequency (RF) link and other communications channels, etc., according to an exemplary embodiment.

In this document, the terms "computer program medium" and "computer readable medium" may be used to generally refer to media such as, e.g., but not limited to removable storage drive 614, a hard disk installed in hard disk drive 612, and signals 628, etc., according to an exemplary embodiment. These computer program products may provide software to computer system 600. The invention may be directed to such computer program products, according to an exemplary embodiment.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic, according to an exemplary embodiment. Further, repeated use of the phrase "in one embodiment," or "in an exemplary embodiment," do not necessarily refer to the same embodiment, although they may, according to an exemplary embodiment.

In the following description and claims, the terms "coupled" and "connected," along with their derivatives, may be used, according to an exemplary embodiment. It should be understood that these terms are not intended as synonyms for each other. Rather, in particular embodiments, "connected" may be used to indicate that two or more elements are in direct or indirect physical or electrical contact with each other, according to an exemplary embodiment. "Coupled" may mean that two or more elements are in direct physical or electrical contact, according to an exemplary embodiment. However, "coupled" may also mean that two or more elements are not in direct contact with each other, but yet still co-operate or interact with each other, according to an exemplary embodiment.

An algorithm is here, and generally, considered to be a self-consistent sequence of acts or operations leading to a desired result, according to an exemplary embodiment. These include physical manipulations of physical quantities, according to an exemplary embodiment. Usually, though not necessarily, these quantities take the form of electrical or magnetic signals capable of being stored, transferred, combined, compared, and otherwise manipulated, according to an exemplary embodiment. It has proven convenient at times, principally for reasons of common usage, to refer to these signals as bits, values, elements, symbols, characters, terms, numbers or the like, according to an exemplary embodiment. It should be understood, however, that all of these and similar terms are to be associated with the appropriate physical quantities and are merely convenient labels applied to these quantities, according to an exemplary embodiment.

Unless specifically stated otherwise, as apparent from the following discussions, it is appreciated that throughout the specification discussions utilizing terms such as "processing," "computing," "calculating," "determining," or the like, refer to the action and/or processes of a computer or computing system, or similar electronic computing device, that manipulate and/or transform data represented as physical, such as electronic, quantities within the computing system's registers and/or memories into other data similarly represented as physical quantities within the computing system's memories, registers or other such information storage, transmission or display devices, according to an exemplary embodiment.

In a similar manner, the term "processor" may refer to any device or portion of a device that processes electronic data from registers and/or memory to transform that electronic data into other electronic data that may be stored in registers and/or memory, according to an exemplary embodiment. A "computing platform" may comprise one or more processors, according to an exemplary embodiment.

Embodiments of the present invention may include apparatuses for performing the operations herein, according to an exemplary embodiment. An apparatus may be specially constructed for the desired purposes, or it may comprise a general purpose device, special purpose devices, devices configured as set forth herein to perform special purpose computing processing selectively activated or reconfigured by a program stored in the device, according to an exemplary embodiment.

Embodiments of the invention may be implemented in one or a combination of hardware, firmware, and software, according to an exemplary embodiment. Embodiments of the invention may also be implemented as instructions stored on a machine-readable medium, which may be read and executed by a computing platform to perform the operations described herein, according to an exemplary embodiment. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other form of propagated signals (e.g., carrier waves, infrared signals, digital signals, etc.) when in non-transitory form, and others, according to an exemplary embodiment.

Computer programs (also called computer control logic), may include object-oriented computer programs, and may be stored in main memory 606 and/or the secondary memory 608, 610 and/or removable storage units 612, 614, also called computer program products, according to an exemplary embodiment. Such computer programs, when executed, may enable the computer system 600 to perform the features of the present invention as discussed herein, according to an exemplary embodiment. In particular, the computer programs, when executed, may enable the processor 602 via communications path 604 to provide a method to resolve conflicts during data synchronization according to an exemplary embodiment. Accordingly, such computer programs may represent controllers of the computer system 600, according to an exemplary embodiment.

In another exemplary embodiment, the invention may be directed to a computer program product comprising a computer readable medium having control logic (computer software) stored therein, according to an exemplary embodiment. The control logic, when executed by the processor(s) 602, may cause the processor 602 to perform the functions of the invention as described herein, according to an exemplary embodiment. In another exemplary embodiment where the invention may be implemented using software, the software may be stored in a computer program product and loaded into computer system 600 using, e.g., but not limited to, removable storage device and/or drive 608, 610, 612 or communications interface 622, 624, etc., according to an exemplary embodiment. The control logic (software), when executed by the processor 602, may cause the processor 602 to perform the functions of the invention as described herein, according to an exemplary embodiment. The computer software may run as a standalone software application program running atop an operating system, or may be integrated into the operating system, according to an exemplary embodiment.

Input and Output devices can include, e.g., but are not limited to, displays, touchscreens, touch enabled panels, LCD screens, OLED screens, flat panel, CRT, LED, and other well known monitors and displays including mobile based screens, foldable displays, virtual reality (VR), augmented reality (AR), mixed reality (MR), holographic, projection based technologies, headset based, handheld, wearables, integrating sensing and tracking, LiDAR, and other sensing based systems, etc.

In yet another embodiment, the invention may be implemented primarily in hardware using, for example, but not limited to, hardware components such as application specific integrated circuits (ASICs), field programmable gate arrays (FPGA), programmable memory (EEPROMS), Printed Circuit Boards (PCBs), specific hardware devices, and/or one or more state machines, etc., according to an exemplary embodiment. Implementation of the hardware state machine so as to perform the functions described herein will be apparent to persons skilled in the relevant art(s), according to an exemplary embodiment.

In another exemplary embodiment, the invention may be implemented primarily in firmware, according to an exemplary embodiment.

In yet another exemplary embodiment, the invention may be implemented using a combination of any of, e.g., but not limited to, hardware, firmware, and software, etc., according to an exemplary embodiment.

Exemplary embodiments of the invention may also be implemented as instructions stored on a machine-readable medium, which may be read and executed by a computing platform to perform the operations described herein, according to an exemplary embodiment. A machine-readable medium may include any mechanism for storing or transmitting information in a form readable by a machine (e.g., a computer), according to an exemplary embodiment. For example, a machine readable medium may include read only memory (ROM); random access memory (RAM); magnetic disk storage media; optical storage media; flash memory devices; electrical, optical, acoustical or other form of propagated signals (e.g., carrier waves, infrared signals, digital signals, etc.), and others, according to an exemplary embodiment.

According to an exemplary embodiment, the system can include location and/or position sensor(s) such as, e.g., but not limited to, location sensor 632, etc.

Exemplary wireless protocols and technologies used by a communications network may include BLUETOOTH or other short distance wireless, near field communications (NFC), general packet radio service (GPRS), cellular digital packet data (CDPD), mobile solutions platform (MSP), multimedia messaging (MMS), wireless application protocol (WAP), code division multiple access (CDMA), short message service (SMS), wireless markup language (WML), handheld device markup language (HDML), binary runtime environment for wireless (BREW), radio access network (RAN), and packet switched core networks (PS-CN). Also included are various generation wireless technologies. An exemplary non-inclusive list of primarily wireline protocols and technologies used by a communications network includes asynchronous transfer mode (ATM), enhanced interior gateway routing protocol (EIGRP), frame relay (FR), high-level data link control (HDLC), Internet control message protocol (ICMP), interior gateway routing protocol (IGRP), internetwork packet exchange (IPX), ISDN, point-to-point protocol (PPP), transmission control protocol/internet protocol (TCP/IP), routing information protocol (RIP) and user datagram protocol (UDP). As skilled persons will recognize, any other known or anticipated wireless or wireline protocols and technologies can be used.

The embodiments may be employed across different generations of exemplary special purpose index construction wireless devices. This includes 1G-5G according to present paradigms. 1G refers to the first generation wide area wireless (WWAN) communications systems, dated in the 1970s and 1980s. These devices are analog, designed for voice transfer and circuit-switched, and include AMPS, NMT and TACS. 2G refers to second generation communications, dated in the 1990s, characterized as digital, capable of voice and data transfer, and include HSCSD, GSM, CDMA IS-95-A and D-AMPS (TDMA/IS-136). 2.5G refers to the generation of communications between 2G and 3 G. 3G refers to third generation communications systems recently coming into existence, characterized, for example, by data rates of 144 Kbps to over 2 Mbps (high speed), being packet-switched, and permitting multimedia content, including GPRS, 1.times.RTT, EDGE, HDR, W-CDMA. 4G refers to fourth generation and provides an end-to-end IP solution where voice, data and streamed multimedia can be served to users on an "anytime, anywhere" basis at higher data rates than previous generations, and will likely include a fully IP-based and integration of systems and network of networks achieved after convergence of wired and wireless networks, including computer, consumer electronics and communications, for providing 100 Mbit/s and 1 Gbit/s communications, with end-to-end quality of service and high security, including providing services anytime, anywhere, at affordable cost and one billing. 5G refers to fifth generation and provides a complete version to enable the true World Wide Wireless Web (WWWW), i.e., either Semantic Web or Web 3.0, for example. Advanced technologies may include intelligent antenna, radio frequency agileness and flexible modulation are required to optimize ad-hoc wireless networks.

Furthermore, the exemplary game system service provider processes and processors need not be located at the same physical locations. In other words, each processor can be executed at one or more geographically distant processor, over for example, a LAN or WAN connection. A great range of possibilities for practicing the exemplary special purpose unit/station interaction locking/unlocking, authentication and play management system embodiments may be employed, using different networking hardware and software configurations from the ones above mentioned. Although described with reference to an application server and/or a web-based browser-enabled environment, such as, e.g., but not limited to, a JAVA environment, the application could also be implemented in a client server architecture, or as a mobile based app running on iOS or Android, or the like, and can interact with a server of a entrepreneur game system service provider via communication network technology. Also, it is important to note that reference to an electronic network component, is not to require only electronic components, but could also integrate with other common networking equipment including, e.g., but not limited to, optical networking equipment, optical fiber, ATM, SONET, etc.

According to an exemplary embodiment, the application system can include an electronic decision support system (DSS) (not shown), which can interact, e.g., but not limited to, with computer database management system (DBMS), and/or electronic interactive, graphical user interface (GUI) system, according to an exemplary embodiment. Each of the exemplary DSS, DBMS and/or EIGUI system, can then, using e.g., but not limited to, a cryptographic processor and/or a crypto chip controller processor 630, or the like, can then encrypt the data using electronic encryptor, which can make use of one or more cryptographic algorithm electronic logic, which can include encryption code, a cryptographic combiner, etc., and may be stored in encrypted form, according to an exemplary embodiment, in a computer database storage facility, from computer database storage device, and from there the process can continue with use of the cryptographic algorithm electronic logic, and electronic decryptor, which can decrypt and/or provide a process for decrypting encrypted data, and/or by providing such data to the DSS, the DBMS 195, or the EIGUI, if authorized, according to an exemplary embodiment. By using encryption/decryption, certain algorithms can be used, as described above, including, e.g., but not limited to, checksum, AES encryption, RSA, PKI, TLS, FTPS, SFTP, etc. and/or other cryptographic algorithms and/or protocols, according to an exemplary embodiment.

Cryptographic Functions

Cryptographic systems, according to an exemplary embodiment, can provide one or more of the following four example services, according to an exemplary embodiment. It is important to distinguish between these, as some algorithms are more suited to particular tasks, but not to others. To protect patient data, personal data can be encrypted prior to storage and can be decrypted before accessing the data, according to an exemplary embodiment. When analyzing requirements and risks, one needs to decide which of the four functions should be used to protect the proprietary data, according to an exemplary embodiment.

Authentication

Using a cryptographic system, according to an exemplary embodiment, one can establish the identity of a remote user (or system), according to an exemplary embodiment. A typical example is the SSL certificate of a web server providing proof to the user device that user device is connected to the correct server, according to an exemplary embodiment.

The identity is not of the user, but of the cryptographic key of the user, according to an exemplary embodiment. Having a less secure key lowers the trust one can place on the identity, according to an exemplary embodiment.

Non-Repudiation

The concept of non-repudiation is particularly important for financial or e-commerce applications, according to an exemplary embodiment. Often, cryptographic tools are required to prove that a unique user has made a transaction request, according to an exemplary embodiment. It must not be possible for the user to refute his or her actions, according to an exemplary embodiment.

For example, a customer can request a transfer of money from her account to be paid to another account, according to an exemplary embodiment. Later, she claims never to have made the request and demands the money be refunded to the account. If one has non-repudiation through cryptography, one can prove—usually through digitally signing the transaction request, that the user authorized the transaction.

Confidentiality

More commonly, the biggest concern can be to keep information private, according to an exemplary embodiment. Cryptographic systems, according to an exemplary embodiment, have been developed to function in this capacity. Whether it be passwords sent during a log on process, or storing confidential proprietary financial data in a database, encryption can assure that only users who have access to the appropriate key can get access to the proprietary data.

Integrity

One can use cryptography, according to an exemplary embodiment, to provide a means to ensure data is not viewed or altered during storage or transmission, according to an exemplary embodiment. Cryptographic hashes for example, can safeguard data by providing a secure checksum, according to an exemplary embodiment.

Cryptographic Algorithms

Various types of cryptographic systems exist that have different strengths and weaknesses, according to an exemplary embodiment. Typically, the exemplary cryptographic systems can be divided into two classes; 1) those that are strong, but slow to run, and 2) those that are quick, but less secure, according to an exemplary embodiment. Most often a combination of the two approaches can be used, according to an exemplary embodiment (e.g.: secure socket layer (SSL)), whereby we establish the connection with a secure algorithm, and then if successful, encrypt the actual transmission with the weaker, but much faster algorithm, according to an exemplary embodiment.

Symmetric Cryptography

Symmetric Cryptography, according to an exemplary embodiment, is the most traditional form of cryptography, according to an exemplary embodiment. In a symmetric cryptosystem, the involved parties share a common secret (password, pass phrase, or key), according to an exemplary embodiment. Data can be encrypted and decrypted using the same key, according to an exemplary embodiment. These symmetric cryptography algorithms tend to be comparatively fast, but the algorithms cannot be used unless the involved parties have already exchanged keys, according to an exemplary embodiment. Any party possessing a specific key can create encrypted messages using that key as well as decrypt any messages encrypted with the key, according to an exemplary embodiment. In systems involving a number of users who each need to set up independent, secure communication channels, symmetric cryptosystems can have practical limitations due to the requirement to securely distribute and manage large numbers of keys, according to an exemplary embodiment.

Common examples of symmetric algorithms include, e.g., but not limited to, DES, 3DES and/or AES, etc., according to an exemplary embodiment. The 56-bit keys used in DES are short enough to be easily brute-forced by modern hardware and DES should no longer be used, according to an exemplary embodiment. Triple DES (or 3DES) uses the same algorithm, applied three times with different keys giving it an effective key length of 128 bits, according to an exemplary embodiment. Due to the problems using the DES algorithm, the United States National Institute of Standards and Technology (NIST) hosted a selection process for a new algorithm, according to an exemplary embodiment. The winning algorithm was Rijndael and the associated cryptosystem is now known as the Advanced Encryption Standard or AES, according to an exemplary embodiment. For most applications 3DES, according to an exemplary embodiment, is acceptably secure at the current time, but for most new applications it is advisable to use AES, according to an exemplary embodiment.

Asymmetric Cryptography (Also Called Public/Private Key Cryptography)

Asymmetric algorithms, according to an exemplary embodiment, use two keys, one to encrypt the data, and either key to decrypt. These inter-dependent keys are generated together, according to an exemplary embodiment. One key is labeled the Public key and is distributed freely, according to an exemplary embodiment. The other key is labeled the Private Key and must be kept hidden, according to an exemplary embodiment. Often referred to as Public/Private Key Cryptography, these cryptosystems can provide a number of different functions depending on how they are used, according to an exemplary embodiment.

The most common usage of asymmetric cryptography is to send messages with a guarantee of confidentiality, according to an exemplary embodiment. If User A wanted to send a message to User B, User A would get access to User B's publicly-available Public Key, according to an exemplary embodiment. The message is then encrypted with this key and sent to User B, according to an exemplary embodiment. Because of the cryptosystem's property that messages encoded with the Public Key of User B can only be decrypted with User B's Private Key, only User B can read the message, according to an exemplary embodiment.

Another usage scenario is one where User A wants to send User B a message and wants User B to have a guarantee that the message was sent by User A, according to an exemplary embodiment. In order to accomplish this, User A can encrypt the message with their Private Key, according to an exemplary embodiment. The message can then only be decrypted using User A's Public Key, according to an exemplary embodiment. This can guarantee that User A created the message because User A is then the only entity who had access to the Private Key required to create a message that can be decrypted by User A's Public Key, according to an exemplary embodiment. This is essentially a digital signature guaranteeing that the message was created by User A, according to an exemplary embodiment.

A Certificate Authority (CA), whose public certificates are installed with browsers or otherwise commonly available, may also digitally sign public keys or certificates, according to an exemplary embodiment. One can authenticate remote systems or users via a mutual trust of an issuing CA, according to an exemplary embodiment. One can trust their 'root' certificates, according to an exemplary embodiment, which in turn authenticates the public certificate presented by the server, according to an exemplary embodiment.

PGP and SSL are prime examples of systems implementing asymmetric cryptography, using RSA and/or other algorithms, according to an exemplary embodiment.

Hashes

Hash functions, according to an exemplary embodiment, take some data of an arbitrary length (and possibly a key or password) and generate a fixed-length hash based on this input, according to an exemplary embodiment. Hash functions used in cryptography have the property that it can be easy to calculate the hash, but difficult or impossible to re-generate the original input if only the hash value is known, according to an exemplary embodiment. In addition, hash functions useful for cryptography have the property that it is difficult to craft an initial input such that the hash will match a specific desired value, according to an exemplary embodiment.

MD5 and SHA-1 are common hashing algorithms, according to an exemplary embodiment. These algorithms are considered weak and are likely to be replaced in due time after a process similar to the AES selection, according to an exemplary embodiment. New applications should consider using SHA-256 instead of these weaker algorithms, according to an exemplary embodiment.

Key Exchange Algorithms

There are also key exchange algorithms (such as Diffie-Hellman for SSL), according to an exemplary embodiment. These key exchange algorithms can allow use to safely exchange encryption keys with an unknown party, according to an exemplary embodiment.

Algorithm Selection

As modern cryptography relies on being computationally expensive to break, according to an exemplary embodiment, specific standards can be set for key sizes that can provide assurance that with today's technology and understanding, it will take too long to decrypt a message by attempting all possible keys, according to an exemplary embodiment.

Therefore, we need to ensure that both the algorithm and the key size are taken into account when selecting an algorithm, according to an exemplary embodiment.

According to one exemplary embodiment, the stations can be placed outdoors. For example, the mobile stations can be configured to be anchored at particular locations, e.g., in an outdoor setting, such as, e.g., but not limited to, a public park, a private park, a university, a public area, a private area, a regional, state, county and/or national park, according to an exemplary embodiment.

According to an exemplary embodiment, authorized users can be managed via an electronic listing, and/or can allow for payment, and/or awards, etc. via an exemplary block chain and/or other ledger, and/or via electronic payment, and/or credit card and/or other mobile payment system, according to exemplary embodiments.

Figure 7:
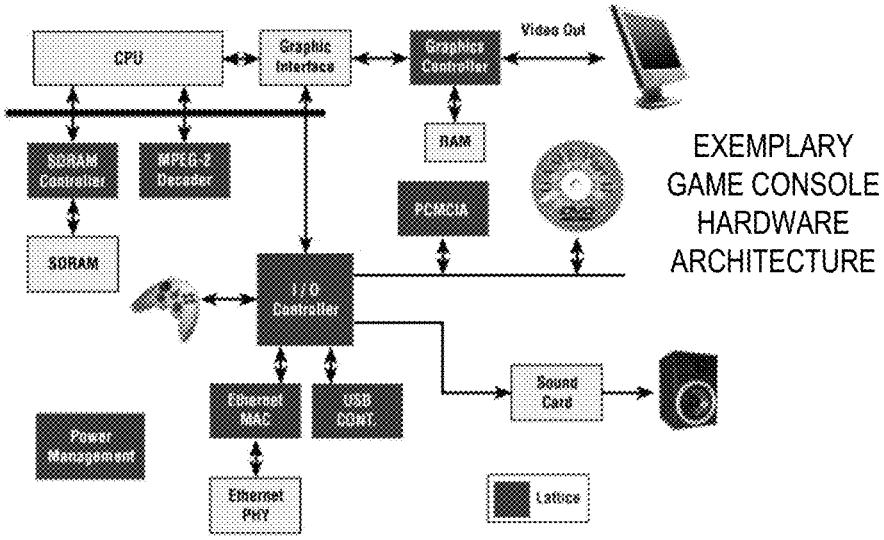
FIGS. 7 and 8 depict an exemplary embodiment of a game console hardware architecture, and an exemplary game network hardware architecture; respectively, as may be included in various exemplary embodiments.

FIG. 7 depicts an exemplary embodiment of a game console hardware architecture, as may be included in various exemplary embodiments. FIG. 7 depicts an exemplary embodiment of a block diagram 700 of an exemplary game console hardware architecture, including an exemplary CPU(s), coupled to an graphic interface to graphics controller, graphics memory and/or graphics and/or video output, audio output, HDMI, max, mini, etc., display connector, VGA, XGA, SVGA, UHD, 4K, 8K, 16K, 32K, 64K, etc., and a bus, exemplary memory SDRAM and memory controller SDRAM controller, and exemplary MPEG decoder, according to an exemplary embodiment. According to an exemplary embodiment, the graphic interface can be coupled to one or more I/o controllers for coupling to exemplary game interactive elements such as, e.g., but not limited to, a game controller such as a Playstation, Xbox, Nintendo Wii, Switch, and the like, etc., external data and/or plugin capable interfaces such as, e.g., but not limited to, a PCMCIA I, II, III, IV, V, etc. interface, a CD-ROM, DVD-ROM/RW, BluRay, UHD BluRay, electronic, magnetic, optical, magneto-optical, Flash memory and/or other storage media, etc., sound card interface and/or speakers, headphones, SONGS, wireless audio, BLUETOOTH, WIFI Audio, and/or audio output systems, optical audio, etc., network interface cards (NICs) such as, e.g., but not limited to, Ethernet MAC, Token Ring, Fibre channel, optical fibre network interface, 10/100/and/or 1000, network interfaces, etc., physical interfaces including twisted pair, shielded twisted pair, CableTV, CATV, optical fibre, enhanced shielded ethernet cabling, IBM cabling system, optical fibre multiplexing, routers and/or switches, firewalls, security equipment, cable moderns, WIFI modems, WIMAX modems, etc., various ports, parallel, serial, fibre, serial bus, universal serial bus (USB) A, B, C, 1.0, 2.0, 3.0, etc., advanced power management, battery and/or AC power supply, and/or voltage regulation and external alternative power AC, DC, etc., and/or or networking infrastructure, etc.

Figure 8:
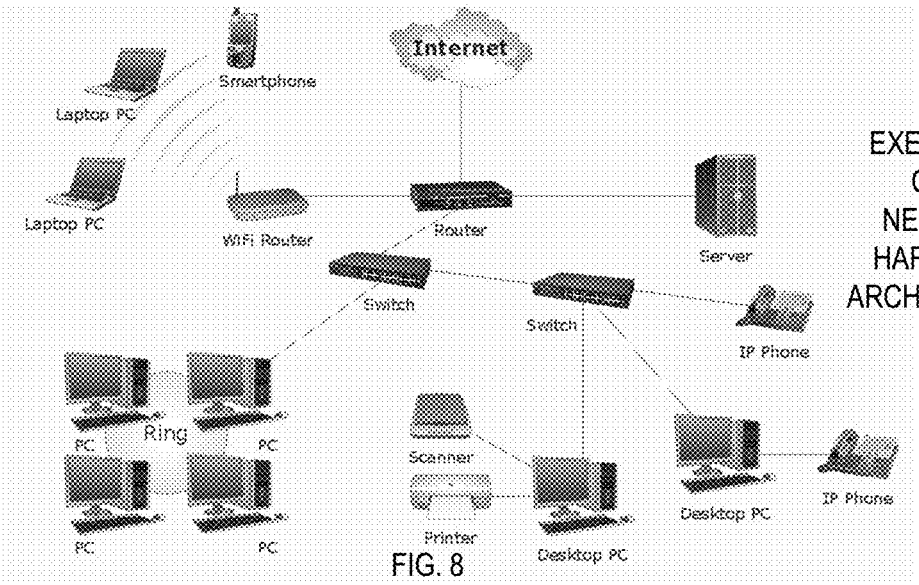

FIG. 8 depict an exemplary embodiment of an exemplary game network hardware architecture, as may be included in various exemplary embodiments.

FIG. 8 depicts an exemplary embodiment of a block diagram 800 of an exemplary game network hardware network architecture, including various exemplary communications network technologies in an exemplary schematic block diagram illustrating exemplary game systems as can be executed on an exemplary unit 118, 202, station 102, user device 104, servers 106, 108, payment systems 110, communication network 112, network 114, station network 112, etc., exemplary laptop and/or notebook and/or PC and/or mobile devices, wired, and/or wirelessly coupled to an exemplary but nonlimiting WIFI router or the like to an exemplary router for access to other routers) and/or host(s) on the internee, and/or servers, and/or clients, and/or peer based devices, and/or Internet of Things (IOT) based appliances, and the like, and/or network switch(es) and/or VoIP devices, and/or IP phones, and/or telephony devices, and/or desktop PCs, server PCs, handheld, laptop, notebook and/or mobile devices, and/or peripheral devices such as, e.g., but not limited to, scanner(s), camera(s), touchscreen(s), other sensors, input devices, mouse, stylus, keypad, keyboard, microphone, output devices, printers, televisions, smarty, monitors, flatscreen, touch-enabled, LCD, LED, OLED, UM LED, QLED, etc., gateways, gateway switches between alternative network topologies, e.g., ring-based topologies, bus topology, CSMA/CD, packet based, token ring, fibre channel, Microwave, IR, RF, 3G, 4G, 5G, 6G, nG, etc., according to various exemplary embodiments.

According to an exemplary embodiment, an exemplary user can carry a mobile device. The mobile device, according to an exemplary embodiment, may be a smart phone (e.g., but not limited to, an iPhone, Google phone, or other phones running an Android or other operating system, a Windows Mobile device, and/or other operating systems, according to an exemplary embodiment), a tablet computer (e.g., iPad, Galaxy Tab, tablet, phablet, smartphone), personal digital assistant (PDA), a notebook computer, personal computer (PC), communication, or computing device, and/or various other types of wireless or wired computing devices, according to an exemplary embodiment. It should be appreciated that the mobile device, according to an exemplary embodiment, may be referred to as a client device or a customer device without departing from the scope of the present disclosure. The mobile device, according to an exemplary embodiment, may have a camera. The mobile device, according to an exemplary embodiment, may communicate over a network or other communications network, such as, e.g., but not limited to, a wireless (e.g., WiFi, BLUETOOTH, and/or WiMax, etc.) and/or wired network, with a service provider or with a website serve, according to an exemplary embodiment. In one embodiment, the service provider, according to an exemplary embodiment, may act as an intermediary between the mobile device and a website server to facilitate user authentication by the website server, and/or other server such as, e.g., but not limited to, a content server.

The network, according to an exemplary embodiment, may be implemented as a single network or a combination of multiple networks, according to an exemplary embodiment. For example, in various embodiments, the network may include the Internet and/or one or more intranets, wireless networks (e.g., cellular, wide area network (WAN), WiFi hot spot, WiMax, personal area network (PAN), Bluetooth, etc.), landline networks and/or other appropriate types of communication networks, according to an exemplary embodiment. As such, in various embodiments, the mobile device may be associated with a particular link (e.g., a link, such as a URL (Uniform Resource Locator) to an IP (Internet Protocol) address, according to an exemplary embodiment).

The exemplary embodiment of the present invention makes reference to wired, or wireless networks. Wired networks include any of a wide variety of well known means for coupling voice and data communications devices together. A brief discussion of various exemplary wireless network technologies that may be used to implement the embodiments of the present invention now are discussed. The examples are non-limited. Exemplary wireless network types may include, e.g., but not limited to, code division multiple access (CDMA), spread spectrum wireless, orthogonal frequency division multiplexing (OFDM), 1G, 2G, 3G. 4G, 5G, 6G, 7G, 8G, nG wireless, Bluetooth, Infrared Data Association (IrDA), shared wireless access protocol (SWAP), "wireless fidelity" (Wi-Fi), WIMAX, and other IEEE standard 802.11-compliant wireless local area network (LAN), 802.16-compliant wide area network (WAN), and ultrawideband (UWB), etc.

BLUETOOTH is an emerging wireless technology promising to unify several wireless technologies for use in low power radio frequency (RF) networks.

IrDA is a standard method for devices to communicate using infrared light pulses, as promulgated by the Infrared Data Association from which the standard gets its name. Since IrDA devices use infrared light, they may depend on being in line of sight with each other.

The exemplary embodiments of the present invention may make reference to WLANs. Examples of a WLAN may include a shared wireless access protocol (SWAP) developed by Home radio frequency (Horn eRF), and wireless fidelity (Wi-Fi), a derivative of WEE 802.11 advocated by the wireless ethernet compatibility alliance (WECA). The IEEE 802.11 wireless LAN standard refers to various technologies that adhere to one or more of various wireless LAN standards. An IEEE 802.11 compliant wireless LAN may comply with any of one or more of the various IEEE 802.11 wireless LAN standards including, e.g., but not limited to, wireless LANs compliant with WEE std. 802.11a, b, d or g, such as, e.g., but not limited to, IEEE std. 802.11 a, b, d and g, (including, e.g., but not limited to IEEE 802.11g-2003, etc.), 802.16, Wi-Max, etc.

Figure 9:
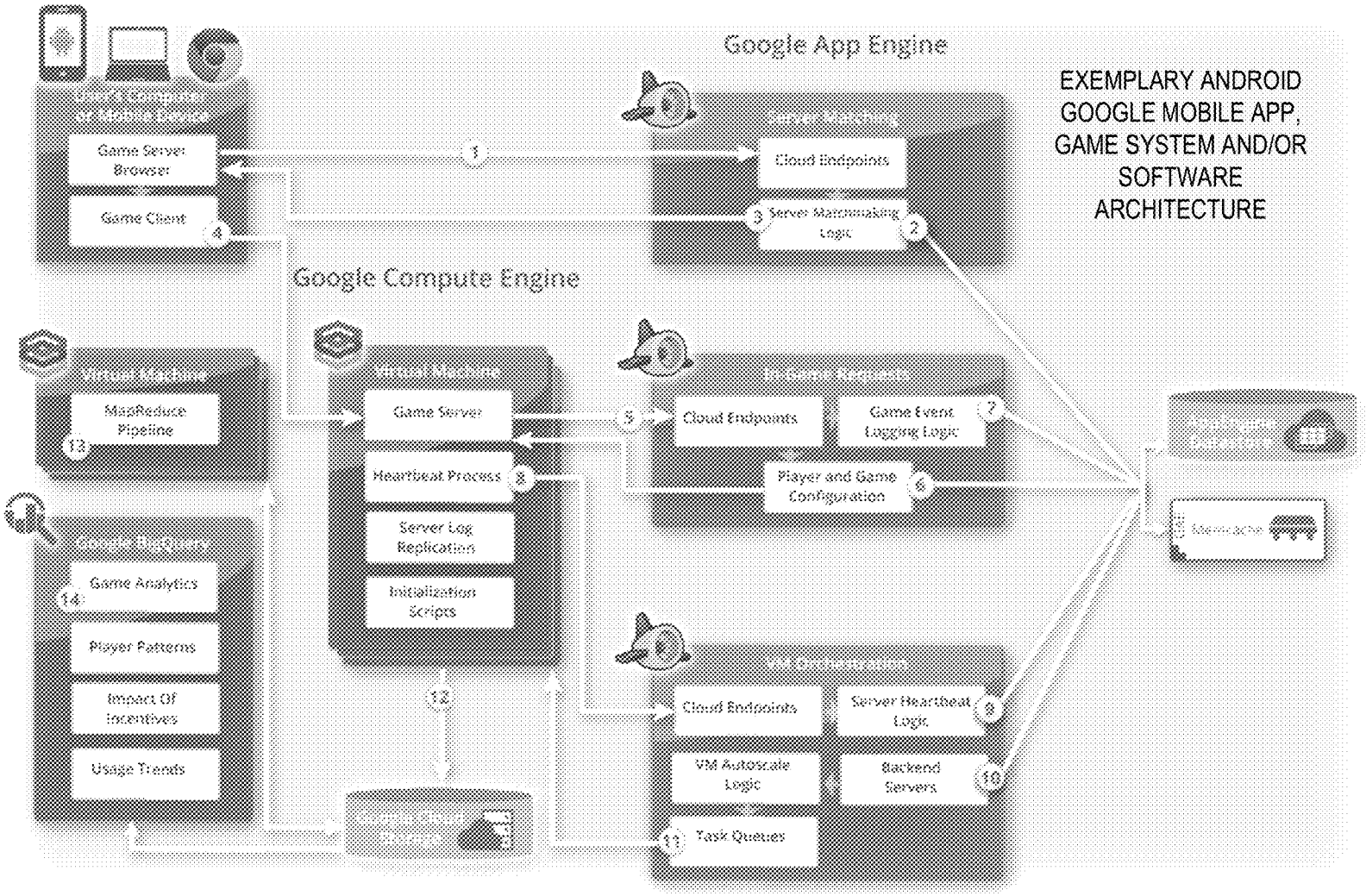
FIG. 9 depicts an exemplary embodiment of an exemplary Android Google mobile app, game system and/or software architecture as can be used in an one embodiment to provide an exemplary game engine for use in implementing an exemplary embodiment of a unit device mobile app game as can be integrated in an exemplary embodiment of a mobile unit, according to one exemplary embodiment.

FIG. 9 depicts an exemplary embodiment of an exemplary Android Google mobile app, game system and/or software architecture as can be used in an one embodiment to provide an exemplary game engine for use in implementing an exemplary embodiment of a unit device mobile app game as can be integrated in an exemplary embodiment of a mobile unit, according to one exemplary embodiment. FIG. 9 depicts an exemplary embodiment of a block diagram 900 illustrating an exemplary Android Google mobile app, multiple units architected on an exemplary ANDROID OS game system and/or software architecture as can be used in one embodiment, according to one exemplary embodiment.

Figure 11:
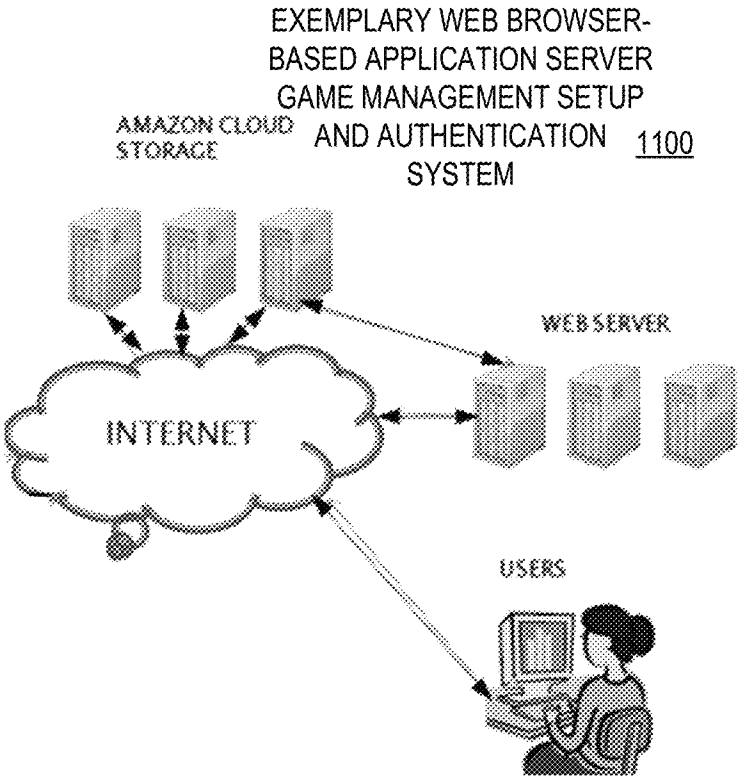
FIGS. 10 and 11 depict an exemplary embodiment of an exemplary cloud-hosted application server entrepreneur game, and an exemplary web browser-based application server exemplary entrepreneur game, respectively, according to various exemplary embodiments.
Figure 10:
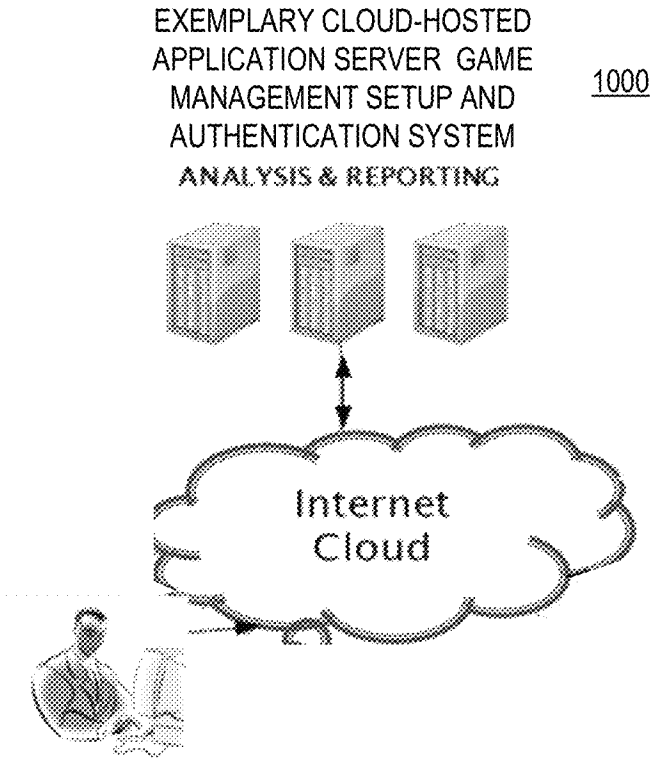
Figures 1, 12:
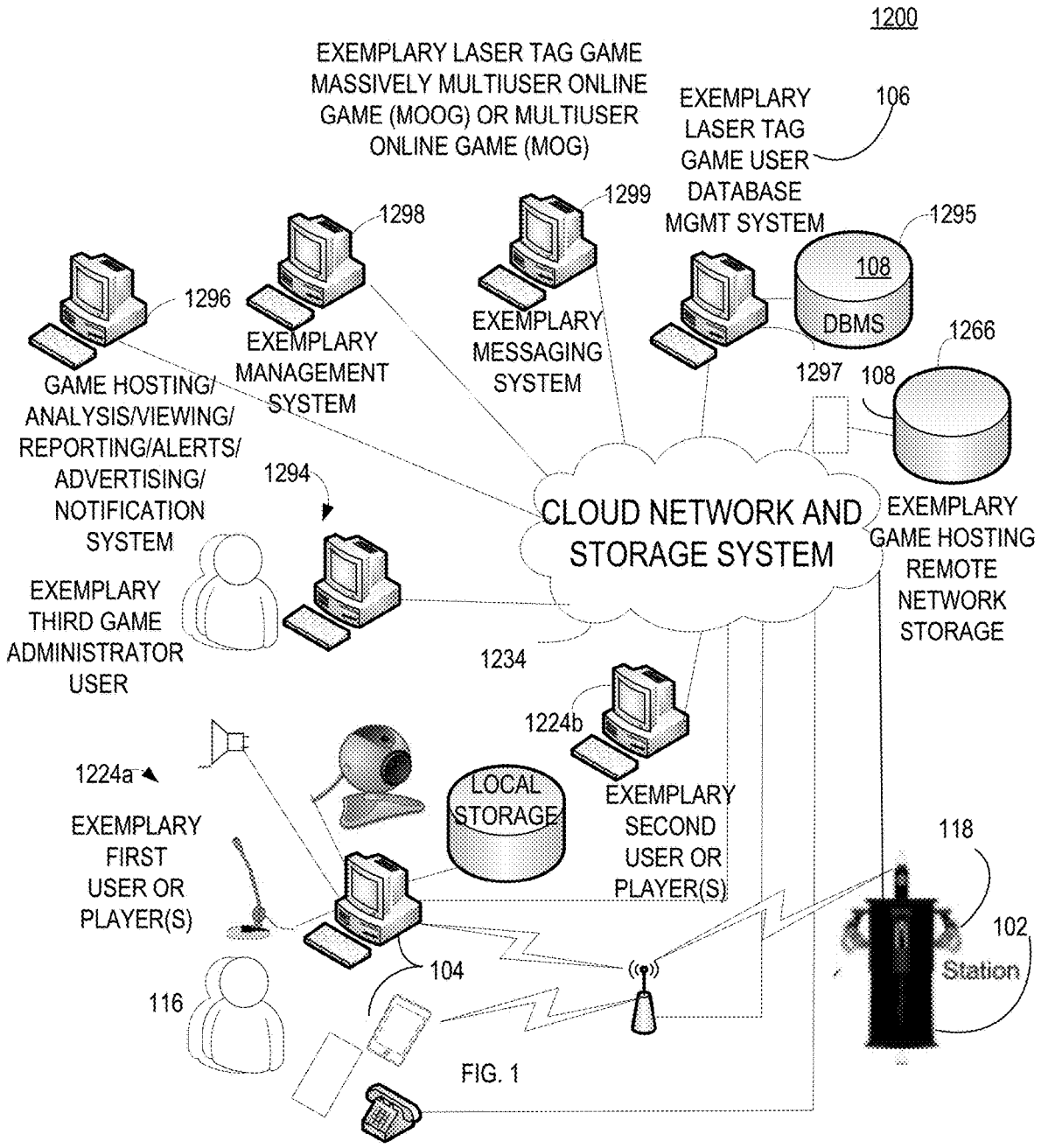
FIG. 12 depicts an exemplary embodiment of an exemplary entrepreneur game massively multiuser online game (MOOG), or multiuser online game (MOG), according to one exemplary embodiment.

FIGS. 10 and 11 depict an exemplary embodiment of an exemplary cloud-hosted application server game 1000, and an exemplary web browser-based application server exemplary game 1100, respectively, according to various exemplary embodiments. An exemplary hardware architecture appears in FIG. 12 below, and an exemplary software architecture appears in FIG. 13 below, according to an exemplary embodiment, FIG. 12 according to an exemplary embodiment of diagram 1200 including an exemplary more detailed hardware architecture diagram providing further details of aspects of exemplary diagram 1000, of FIG. 1. Diagram 1200 illustrates a user 116 at an exemplary user device 104, which may include a computing or communications device 104, which may be coupled to a communications network in a wired and/or wireless fashion as illustrated. According to an exemplary embodiment, a single station 102 with example units 118 is illustrated, but as will be apparent to those skilled in the relevant art, multiple stations 102 can be provided each with multiple units 118, as shown in FIG. 1, et seq. According to an exemplary embodiment, other users including both game player users, subscribers, new and/or potential subscribers, social media contacts, friends, etc., and service provider users, including those creating and managing and maintaining the game application programs and systems, game organization, management, security, authentication, access to and unlocking of units 118 from skates 204 on stations 102, gameplay authentication, processing of payments via payment systems, electronic invoicing/billing/electronic payment processing, database management, datastore maintenance, inter game communication, signaling, user interface interaction, decision support systems, alerts, notifications, advertising, reporting, setup and management of massively multiuser online games via station to server, and/or station to station and/or unit to station, and/or unit to unit, and/or unit to server communication, and the like, can be in electronic network communication as illustrated using exemplary devices 1224*a*, 1224*b*, 1294, 1296, 1298, 1299, 106, 1297, 1295, and 1266, as shown, coupled to one another via exemplary cloud and/or communications network 1234, according to an exemplary embodiment.

Figure 13:
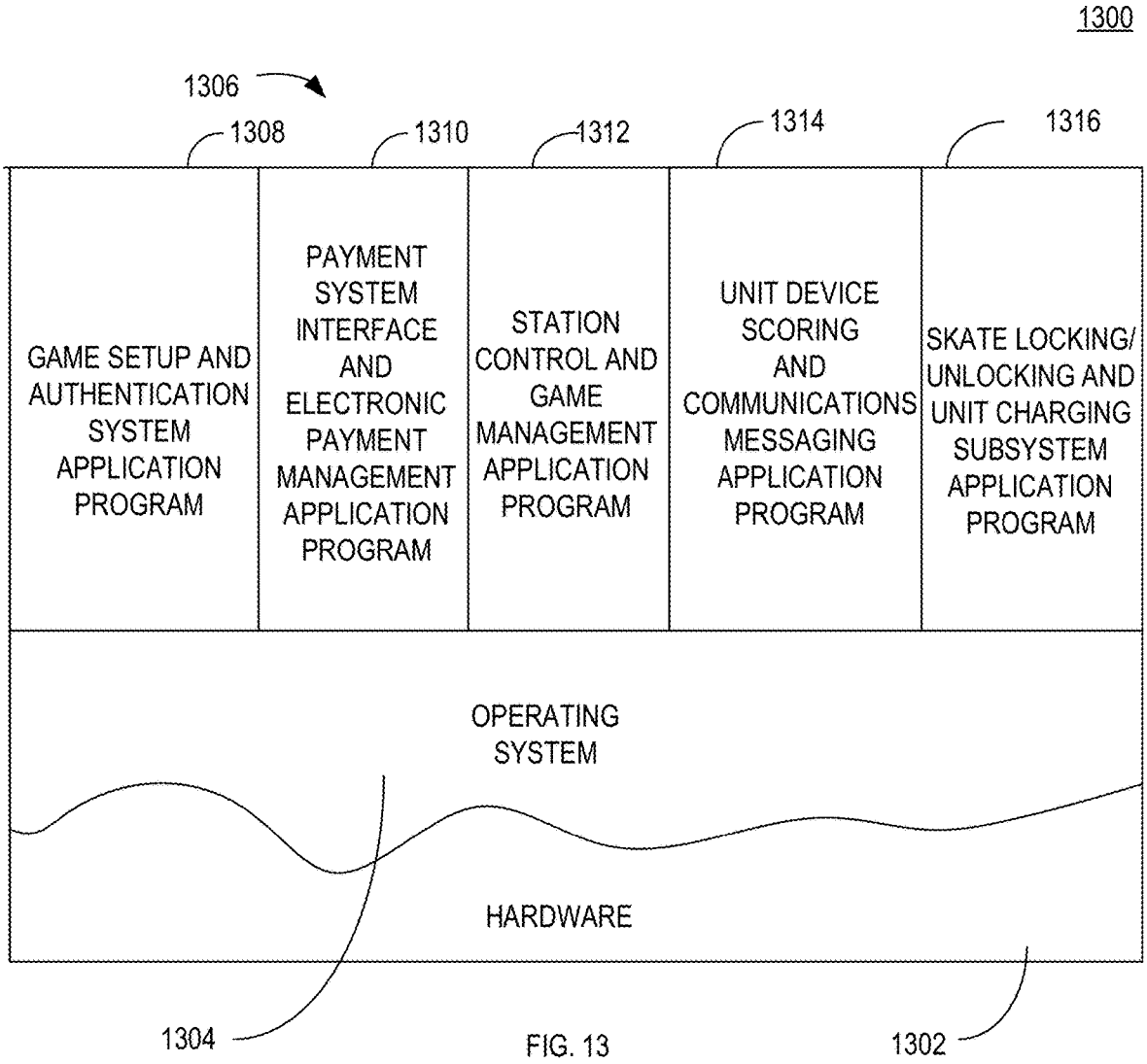
FIG. 13 depicts an exemplary embodiment of a software architecture for an exemplary server service provider application program system for managing interaction between stations and units including exemplary laser tag games or other units interaction and locking/unlocking, charging, payment systems, scoring, communications, messaging and related control functionality, etc., according to an exemplary embodiment.

FIG. 13 according to an exemplary embodiment of diagram 1300 including an exemplary software architecture diagram providing exemplary details of an exemplary application software system for providing various exemplary functional aspects as detailed throughout the application. According to an exemplary embodiment, exemplary diagram 1300 can include, according to an exemplary embodiment a hardware layer 1302, which may include, e.g., but not limited to, the hardware systems illustrated in the other figures, and can include, e.g., a controller, and/or microcontroller and/or computer processor, which in combination with memory can execute one or more instructions of a general purpose and/or special purpose operating system layer 1304 for enabling the exemplary functionality set forth in this special purpose system described herein, according to various exemplary embodiments to allow execution of various exemplary application programs 1306, including, e.g., but not limited to an exemplary game setup and/or authentication system application program 1308, an exemplary payment system interface and/or electronic payment management application program 1310, exemplary station control and/or game management application program 1312, exemplary unit device exemplary scoring and/or gameplay management, and/or data collection and/or storage and/or transmission and/or messaging and/or communication application program 1314, and/or exemplary skate locking unlocking and/or unit charging subsystem application program, according to an exemplary embodiment. Various exemplary functionality mentioned elsewhere herein including the control of exemplary energy storage and/or energy generation/production systems, charging of energy storage systems, use of renewable energy via inverters, microgrids and the like and/or integration into new 5G and beyond wireless communication infrastructure is also contemplated within exemplary embodiment. Various well know laser tag gameplay functionality and game setup, and user authentication and RFID reading application software, social media sharing of game scoring, game play summary, messaging, notifications, and the like are also contemplated and used in various exemplary embodiments.

Exemplary embodiments of the present invention can include a unit device such as, e.g., but not limited to, a laser tag gun as available, e.g., but not limited to, SKIRMOS. According to another exemplary embodiment, another laser tag gun can be used. According to another exemplary embodiment, a user can log in with a phone, and a GPS on the mobile device can be used to identify a nearest station and can provide a way to find the station. According to another exemplary embodiment, a monthly subscription service can be electronically set up, and can then allow for unlocking, and locking the user device from an exemplary skate of the exemplary station. According to another exemplary embodiment, the unit device can be charged by wireless charging. According to another exemplary embodiment, an RFD scanner can be placed on the station and an RFID tag can be placed on the unit device, to assist in recognizing the device. According to an exemplary embodiment, the station and/or the user device can include a LINUX operating system executing computing device. According to an exemplary embodiment, games can be pushed from the exemplary cell tower to the exemplary station or the exemplary unit device, via an exemplary GSM or other connection including wired or wireless communication methods. According to another exemplary embodiment, a station can support 1, 2, 3, 4, 5, 6, 7, 8, 9, 10, and/or more unit devices. According to another exemplary embodiment, a station can support up to 3 unit devices. According to another exemplary embodiment, a game engine can be provided. According to another exemplary embodiment, a device to device mesh network can be used as set forth in US Patent Publication 20160037469, the contents of which is incorporated herein by reference in its entirety. According to another exemplary embodiment, a laser gun with infrared light and/or sensors can be provided. According to another exemplary embodiment, other wearable sensors can be used. According to another exemplary embodiment, a WIFI coupled Station can be used, which can be coupled to exemplary unit devices by WIFI, or another wireless protocol. According to another exemplary embodiment, an indoor sensor can be provided. According to another exemplary embodiment, an outdoor sensor can be provided. According to another exemplary embodiment, a hub which can be used indoor and/or outdoor can be provided. According to another exemplary embodiment, a dome sensor can be provided. According to another exemplary embodiment, unit devices can be capable of being coupled to the Internet for software changes and/or updates and/or downloads. According to another exemplary embodiment, the unit devices and/or the station(s) can be configured to be coupled to a mobile device, such as, e.g., but not limited to, a mobile device can be coupled to a device by an exemplary USB or other physical connection and/or wirelessly via an exemplary BLUETOOTH, NRF, Radio, IR, RF, WIFI and/or other wireless connection, can, e.g., but not limited to, provide for charging of the mobile device for a fee, and/or other complementary services, etc. According to another exemplary embodiment, a unit device can include an exemplary display screen (e.g., LCD), microphone and/or speaker(s), an exemplary scope, one or more colored LEDs, an exemplary USB or other data port, an exemplary printed circuit board (PCB), an exemplary microprocessor and/or microcontroller, and/or memory, an exemplary rumble motor or other haptic features, an exemplary trigger, and exemplary handle an exemplary barrel, an exemplary IR emitter LED for shooting, and/or an exemplary one or more, or a plurality of IR receivers/sensors, or exemplary five IR sensors, an exemplary radio antenna with an exemplary range of ½ mile, a mile, less, and/or more, etc., an exemplary power supply and/or energy storage device such as, e.g., but not limited to, a rechargeable lithium ion phosphate battery, and/or the like, an exemplary dimmable screen for saving battery, exemplary USB type B or type C, etc., an exemplary removable or nonremovable SD memory card, an exemplary optical lens and/or emitter LED, an exemplary keypad and/or D pad, and/or button like an Xbox, firestick remote, or the like, etc., other i/O, etc. According to another exemplary embodiment, a head up screen and/or augmented reality device can incorporated to provide an exemplary virtual reality and/or augmented and/or mixed reality experiences including, e.g., but not limited to, a Magic Leap 1, a Magic Leap 2, etc, Google Glass, an OCULUS, a HOLOLENS, an AZURE Kinect DK device, a Hololens 2 device, an Oculus RIFT, SAMSUNG GEAR, an Avegant Glyph AG101, an Acer Windows MR headset, a SAMSUNG Odyssey+ & Windows Mixed Reality VR headset, Samsung Odyssey, a Dell Visor, an HP Windows Mixed Reality device, incorporated into an exemplary laser tag experience. According to another exemplary embodiment, can include exemplary tennis ball like grenades with integrated sensors. According to another exemplary embodiment, exemplary drones can be exemplary unit devices. According to another exemplary embodiment, an exemplary drone with extensive sensors can be a roving target and/or hub and can allow users to play a game in concert with the exemplary drone, and the drone can include an exemplary controller coupled with it. According to another exemplary embodiment, a ceiling mounted dome can be provided for indoor play and/or collection of data from gameplay. According to another exemplary embodiment, more than one dome can be coupled to one another by exemplary wired and/or wireless communication.

Various exemplary embodiments of the invention are discussed in detail below. While specific exemplary embodiments are discussed herein, it should be understood that this is done for illustration purposes only. A person skilled in the relevant art will recognize that other components and configurations can be used without parting from the spirit and scope of the invention.

What is claimed is:

1. A method for managing a game comprising:

receiving, by at least one electronic computer processor, a request to establish a game;

establishing, by said at least one electronic computer processor, said game comprising:

authenticating, by said at least one electronic computer processor, a plurality of authorized users;

unlocking, by said at least one electronic computer processor, a plurality of unit devices to provide each of the plurality of the unit devices to each of the plurality of authorized users from at least one station of at least one service provider system, wherein said at least one service provider system comprises:

at least one skate coupled to the at least one station; and at least one station controller coupled to each of said at least one skate;

at least one station memory coupled to said at least one station controller;

at least one station energy storage device coupled to said at least one station controller;

at least one station energy storage controller coupled to at least one or more of said at least one station controller, said at least one station energy storage device, or the at least one skate;

at least one station radio configured to communicate with each of the plurality of unit devices, and coupled to said at least one station controller; and at least one communication network interface for coupling the at least one station to said at least one service provider system, and coupled to said at least one station controller; and managing, by said at least one electronic computer processor, the game between the plurality of unit devices.

2. The method according to claim 1, wherein said receiving a request to establish a game comprises at least one or more of:

receiving, by said at least one electronic computer processor, a request to establish a laser tag game;

receiving, by said at least one electronic computer processor, a request of one game from a plurality of available games; or receiving, by said at least one electronic computer processor, a request of one game from a plurality of available laser tag games.

3. The method according to claim 1, wherein said authenticating the plurality of authorized users comprises:

authenticating, by said at least one electronic computer processor, a plurality of users to establish a laser tag game;

receiving, by said at least one electronic computer processor, authenticating information from a mobile device; or receiving, by said at least one electronic computer processor, confirmation that a payment system has collected electronic payment to allow the plurality of users to play the laser tag game.

4. The method according to claim 1, wherein said station is coupled via a communication network to a service provider computing device.

5. The method according to claim 1, wherein said at least one station is wirelessly coupled to said plurality of unit devices.

6. The method according to claim 1, further comprising:

providing, by said at least one electronic computer processor, for electrically charging said plurality of unit devices via said at least one station.

7. The method according to claim 1, further comprising:
receiving, by said at least one electronic computer processor, the plurality of unit devices back into the at least one station upon completion of the game.

8. The method according to claim 1, wherein said managing the game comprises at least one of:
transmitting, by said at least one electronic computer processor, commands from the at least one station to the plurality of unit devices via the at least one station;
coordinating, by said at least one electronic computer processor, play of the game;
receiving, by said at least one electronic computer processor, from the plurality of unit devices scores; or
scoring, by said at least one electronic computer processor, the game.

9. A system for managing a game comprising:
at least one service provider system comprising:
at least one computer processor; and
at least one memory coupled to said at least one computer processor; and
wherein said at least one computer processor is configured to:
receive a request to establish a game;
establish said game comprising configuring said at least one computer processor to:
authenticate a plurality of authorized users;
unlock a plurality of unit devices to provide each of the unit devices to each of the plurality of authorized users from at least one station,
wherein said at least one service provider system comprises:
at least one skate coupled to the at least one station; and
at least one station controller coupled to each of said at least one skate:
at least one station memory coupled to said at least one station controller;
at least one station energy storage device coupled to said at least one station controller;
at least one station energy storage controller coupled to at least one or more of said at least one station controller, said at least one station energy storage device, or said at least one skate;
at least one station radio configured to communicate with each of the plurality of unit devices, and coupled to said at least one station controller; and
at least one communication network interface for coupling the at least one station to said at least one service provider system, and coupled to said at least one station controller; and
manage the game between the plurality of unit devices.

10. The system according to claim 9, wherein each of the plurality of unit devices is locked or unlocked from said at least one skate of the at least one station, and wherein said at least one skate comprises:
at least one skate coupler configured to interact with at least one unit coupler of at least one of the plurality of unit devices.

11. The system according to claim 10, wherein each of the unit devices of the plurality of the unit devices comprises:
at least one unit device controller;
at least one unit device memory coupled to said at least one unit device controller;
at least one unit device radio coupled to said at least one unit device controller, said at least one unit device radio configured to communicate with said at least one station radio;
at least one unit device energy storage device coupled to said at least one unit device controller; and
at least one user interface coupled to said at least one unit device controller.

12. The system according to claim 10, wherein each of said at least one skates communicates with the at least one station by i2C protocol communication.

13. The system according to claim 9, wherein each of said unit devices comprises at least one or more of:
at least one laser tag unit device;
at least one laser tag gun; or
at least one tool.

14. The system according to claim 9, wherein each of said unit devices is not a bicycle, each of said unit devices is not an automated scooter, and each of said unit devices is not an automobile.

15. The system according to claim 9, wherein each of the unit devices communicates with the at least one station by radio communication.

16. The system according to claim 9, wherein each of the unit devices communicates with said at least one skate by RFD card reader communication.

17. The system according to claim 9, wherein each of the plurality of unit devices is a toy and not a vehicle.

18. The system according to claim 9, wherein each of the plurality of unit devices comprises at least one or more of:
is a toy,
is not a vehicle,
is a vehicle other than a scooter,
is not a scooter,
is not an electric scooter, and/or
is not a rechargeable scooter.

19. The system according to claim 9, wherein said at least one service provider system further comprises at least one or more of:
wherein each of said at least one skate comprises at least one or more of:
a mechanical coupler component,
a mechanical docking interface;
an electromechanical docking interface;
an electronic signaling interface;
an identification interface; or
an electromechanical interface;
wherein the plurality of unit devices is locked or unlocked, mechanically and electronically from said at least one skate;
wherein said at least one skate comprises a skate coupling mechanism;
wherein each said at least one skate comprises at least one or more of:
at least one skate controller, said at least one skate controller configured to communicatively interact with said at least one station controller;
at least one skate memory coupled to said at least one skate controller;
at least one skate charger; or
at least one radio frequency identification (RFID) reader coupled to said at least one skate controller, said at least one RFID reader configured to read an RFID tag of at least one of said plurality of unit devices;
wherein each said at least one skate comprises at least one skate coupler comprising at least one or more of:
at least one mechanical coupler component,
at least one electromechanical docking interface;
at least one identification interface;
at least one latch; or
at least one lock;
wherein each said at least one skate comprises at least one skate charger coupled to at least one skate controller, said at least one skate charger configured to charge at least one battery of at least one of the plurality of unit devices;

wherein each of the plurality of unit devices comprises at least one or more of:

a removable rechargeable battery pack;

a rechargeable battery pack;

a nonremovable rechargeable battery pack and a charging interface; or a nonremovable battery pack;

wherein said at least one unit coupler of at least one of the plurality of unit devices comprises at least one or more of:

a latch; or a lock; or wherein each of the plurality of unit devices comprises at least one or more of:

at least one unit coupler configured to interact with a skate coupler of the at least one skate;

at least one unit coupler comprising at least one of a lock or a latch, said at least one unit coupler configured to interact with a skate coupler of the at least one skate;

at least one unit device energy storage device comprising at least one or more of a replaceable or a rechargeable energy storage device;

at least one unit device energy storage device coupled to at least one unit device controller;

at least one unit device energy storage device coupled to at least one unit device controller coupled to at least one unit device charge contact configured to interact with at least one skate charger;

at least one unit device latch coupled to at least one unit device controller and configured to interact with at least one skate coupler;

at least one unit device latch coupled to at least one unit device controller and configured to interact with at least one skate lock;

at least one location sensor coupled to at least one unit device controller; or at least one location sensor comprising at least one or more of a proximity sensor, a location sensor, position sensor, an infrared (IR) sensor, a focused IR sensor, an indoor sensor, an outdoor sensor, a roving target sensor, a hub sensor, a biometric sensor, an electromagnetic field (EMF) sensor, a light sensor, a wearable sensor, a dome sensor, a receiver, a transceiver, or other sensor, coupled to at least one unit device controller;

an input device; or an output device.

20. A non-transitory computer accessible medium embodying program code instructions, which when executed by at least one computer processor perform a method for managing a game, wherein the method comprises:

receiving a request to establish a game;

establishing said game comprising:

authenticating a plurality of authorized users;

unlocking a plurality of unit devices to provide each of the plurality of unit devices to each of the plurality of authorized users from at least one station of at least one service provider system, wherein said at least one service provider system comprises:

at least one skate coupled to the at least one station; and at least one station controller coupled to each of said at least one skate:

at least one station memory coupled to said at least one station controller;

at least one station energy storage device coupled to said at least one station controller;

at least one station energy storage controller coupled to at least one or more of said at least one station controller, said at least one station energy storage device, or said at least one skate;

at least one station radio configured to communicate with each of said plurality of unit devices, and coupled to said at least one station controller; and at least one communication network interface for coupling said at least one station to said at least one service provider system, and coupled to said at least one station controller; and managing the game between the plurality of unit devices.

* * * * *